US011203026B2

(12) United States Patent
Ding

(10) Patent No.: US 11,203,026 B2
(45) Date of Patent: Dec. 21, 2021

(54) LIQUID PUMP

(71) Applicant: Yaowu Ding, Jiangsu (CN)

(72) Inventor: Yaowu Ding, Jiangsu (CN)

(73) Assignee: Yaowu Ding, Jiangsu (CN)

( * ) Notice: Subject to any disclaimer, the term of this patent is extended or adjusted under 35 U.S.C. 154(b) by 0 days.

(21) Appl. No.: 16/765,572

(22) PCT Filed: Aug. 13, 2018

(86) PCT No.: PCT/CN2018/100161
§ 371 (c)(1),
(2) Date: May 20, 2020

(87) PCT Pub. No.: WO2019/100764
PCT Pub. Date: May 31, 2019

(65) Prior Publication Data

US 2020/0306779 A1 Oct. 1, 2020

(30) Foreign Application Priority Data

Nov. 21, 2017 (CN) ..... 201711164700.4

(51) Int. Cl.
*B05B 11/02* (2006.01)
*B65D 47/00* (2006.01)
*B05B 11/00* (2006.01)

(52) U.S. Cl.
CPC ..... *B05B 11/02* (2013.01); *B05B 11/3011* (2013.01); *B05B 11/3057* (2013.01);
(Continued)

(58) Field of Classification Search
CPC ..... B05D 11/02; B65D 47/00; B05B 11/02; B05B 11/0089; B05B 11/3011; B05B 11/3074; B05B 11/3077; B05B 11/3057
See application file for complete search history.

(56) References Cited

U.S. PATENT DOCUMENTS 3,452,905 A * 7/1969 Micallef ..... G01F 11/08 222/207
5,673,824 A * 10/1997 Evans ..... B05B 11/0005 222/321.1

(Continued)

FOREIGN PATENT DOCUMENTS

CN 202591008 U 12/2012
CN 202621361 U 12/2012

(Continued)

OTHER PUBLICATIONS

International Search Report and Written Opinion dated Nov. 12, 2018, for corresponding International Application No. PCT/CN2018/100161, filed on Aug. 13, 2018; consisting of 10-pages.

*Primary Examiner* — Frederick C Nicolas
(74) *Attorney, Agent, or Firm* — Christopher & Weisberg, P.A.

(57) ABSTRACT

Disclosed is a liquid pump (100, 200, 300, 400, 500, 600, 700, 800, 900), including a movable unit and a fixed unit. The movable unit is capable of moving relative to the fixed unit so as to pump a product out. An elastic mechanism (130, 230, 330, 430, 530, 630, 730, 820, 930) is provided between the movable unit and the fixed unit, and the elastic mechanism (130, 230, 330, 430, 530, 630, 730, 820, 930) comprises at least one elastic strip (131, 231, 331, 431, 531, 631, 731, 821, 931). The elastic strip (131, 231, 331, 431, 531, 631, 731, 821, 931) applies a biasing force to the movable unit to restore the movable unit after the product is pumped. The liquid pump (100, 200, 300, 400, 500, 600, 700, 800, 900) further comprises an elastic mechanism adjusting member movable between a first position in which the elastic strip (131, 231, 331, 431, 531, 631, 731, 821, 931) of the elastic mechanism (130, 230, 330, 430, 530, 630, 730, 820, 930) is in a relaxed state, and a second position in which the elastic strip (131, 231, 331, 431, 531, 631, 731, 821, 931)
(Continued)

of the elastic mechanism (130, 230, 330, 430, 530, 630, 730, 820, 930) is in a preloaded state. With the provision of the elastic mechanism adjusting member, it is convenient to press down a pressing head (110, 210, 310, 410, 510, 610, 710, 910) during use, and the yielding deformation of the elastic strip (131, 231, 331, 431, 531, 631, 731, 821, 931) due to long-term stress can also be avoided.

9 Claims, 20 Drawing Sheets

(52) U.S. Cl.
CPC ..... *B05B 11/3074* (2013.01); *B05B 11/3077* (2013.01); *B65D 47/00* (2013.01); *B05B 11/0089* (2013.01)

(56) References Cited

U.S. PATENT DOCUMENTS 5,746,728 A * 5/1998 Py ..... A61F 9/0008 604/298
6,033,384 A * 3/2000 Py ..... A61F 9/0026 604/186
6,805,267 B2 * 10/2004 Bougamont ..... B05B 11/0064 222/207
9,539,597 B2 * 1/2017 Ding ..... B05B 11/3001
10,138,971 B1 * 11/2018 Deman ..... F16F 1/373
10,794,445 B2 * 10/2020 Deman ..... F16F 1/44
2004/0055457 A1 * 3/2004 Masuda ..... B05B 11/3035 92/13
2004/0149777 A1 * 8/2004 Santagiuliana ..... B05B 11/3023 222/190
2010/0301070 A1 * 12/2010 Allef ..... A47K 5/1208 222/207
2015/0136810 A1 * 5/2015 Ding ..... B05B 11/305 222/321.9

FOREIGN PATENT DOCUMENTS

CN 203568119 U 4/2014
CN 103964056 A 8/2014
CN 104071437 A 10/2014
CN 207482522 U 6/2018
GB 1435190 A 5/1976

* cited by examiner

LIQUID PUMP

CROSS-REFERENCE TO RELATED APPLICATIONS

This application is a submission under 35 U.S.C. § 371 for U.S. National Stage Patent Application of, and claims priority to, International Application Number PCT/CN2018/100161 entitled LIQUID PUMP filed Aug. 13, 2018, which is related to and claims priority to Chinese Application Serial No. 201711164700.4, filed Nov. 21, 2017, the entirety of all of which are incorporated herein by reference.

TECHNICAL FIELD

The present invention relates to a liquid pump. Here, the so-called "liquid" includes a flowable or semi-flowable product in liquid, semi-liquid and other states.

BACKGROUND ART

In fields such as toiletries, containers used therewith usually comprise liquid pumps to dispense products from the containers. Users pump the products by applying pressure to actuation members on the liquid pumps. After pumping the product once, a restoring mechanism installed on the liquid pump will restore the actuation member to an unpressed position thereof, i.e. to restore the actuation member for the next pumping.

At present, the restoring mechanisms for the liquid pumps on the market usually have the following types:

one is a plastic spring in the shape of a bellows. As shown in FIG. 28, a bellows-shaped spring 1300 is provided between a pressing head 1100 and a threaded sleeve 1200 of a liquid pump 1000. When the product is to be dispensed, the pressing head 1100 is pressed such that the pressing head 1100 moves downwardly against a spring force from the spring 1300. After the product is dispensed out, the pressure is removed from the pressing head 1100, such that the pressing head 1100 moves upwardly and returns to an initial position under the action of the spring force from the spring 1300.

For this bellows-shaped plastic spring 1300, there is a problem that the spring force is insufficient. If the product to be pumped is relatively viscous or the pumping volume is relatively large, the rebounding of the pressing head 1100 will be difficult, and may even fail to rebound due to the insufficient spring force. This will affect the continued use of the container of the product. Against this problem, in order to enable the pressing head of the liquid pump to rebound into place after use, the current common practice is to preload the bellows-shaped spring before use such that same bears a certain pre-compressed deformation. However, this will cause other problems. For example, if the bellows-shaped spring has always been in a preloaded state, the yielding deformation will occur after a long time, such that the amount of pre-compressed deformation caused by the original preload disappears. In this way, after a long period of storage or use, the problem of not being able to rebound into place will still occur.

Another type of restoring mechanism is a sleeve-type spring. As shown in FIG. 29, a sleeve-type spring 2300 is formed on a pressing head 2100 of a liquid pump 2000, a lower end of the sleeve-type spring 2300 abuts against a threaded sleeve 2200, and the threaded sleeve is provided with a plurality of longitudinal slits, such that an elastic strip is formed between adjacent slits. When the pressing head

2100 is pressed down, the elastic strip is compressed and bent, and when the pressure is removed, the elastic strip returns to a vertical unstressed state under the action of its elastic force, thereby causing the pressing head 2100 to rebound.

One problem with this sleeve-type spring 2300 is that when the pressing head 2100 is near an upper dead point, a great downward-pressing force is required to press the pressing head 2100 down, and some users will not be able to press the pressing head; and when the pressing head 2100 reaches a lower dead point of its stroke, the elastic strip of the spring 2300 may be excessively deformed, resulting in a relatively small rebound force for the pressing head, so that the pressing head rebounds slowly, and sometimes cannot be completely restored, affecting the next use.

Therefore, there is a need for an improved liquid pump that can overcome the technical problems in the prior art described above.

SUMMARY OF THE INVENTION

The present invention has been made based on the above technical problems of the prior art, and its object is to provide a liquid pump with an improved structure in which a pressing head of the liquid pump is pressed down without requiring a large downward-pressing force, and the yielding deformation of an elastic strip due to long-term stress can also be avoided.

A liquid pump of the present invention comprises a movable unit and a fixed unit, the movable unit being capable of moving relative to the fixed unit so as to pump a product out, an elastic mechanism being provided between the movable unit and the fixed unit, and the elastic mechanism comprising at least one elastic strip which applies a biasing force to the movable unit to restore the movable unit after the product is pumped, wherein the liquid pump further comprises an elastic mechanism adjusting member formed on or connected to the elastic mechanism, and the elastic mechanism adjusting member is movable between a first position in which the elastic strip of the elastic mechanism is in a relaxed state, and a second position in which the elastic strip of the elastic mechanism is in a preloaded state.

With the liquid pump of the present invention, when not in use, the elastic strip of the elastic mechanism is in the relaxed state, and when in use, the elastic strip can be preloaded first. In this way, there is no need to use too much pressing force to press the pressing head during use, and when not in use, the yielding deformation of the elastic strip due to long-term stress can also be avoided, which results in the failure of the liquid pump.

In the present invention, the elastic mechanism is made of a non-metallic material with elasticity. For example, the material used to manufacture the elastic mechanism may be elastic plastic, rubber, etc.

One type of liquid pump is a press-type liquid pump, wherein the movable unit comprises a pressing head and a piston rod connected to the pressing head; and the fixed unit comprises a threaded sleeve and a cylinder connected to the threaded sleeve.

For the press-type liquid pump, the specific structure of the elastic mechanism adjusting member may adopt some of the following embodiments.

In a first embodiment, the elastic mechanism comprises an upper base and a lower base, the upper base rotatably abuts against the pressing head, and the lower base rotatably abuts against the threaded sleeve; the elastic mechanism adjusting member comprises the lower base, wherein a lower surface of the lower base is formed with a raised supporting face and a recessed supporting face, a bump is formed on the threaded sleeve, the recessed supporting face is mated with the bump when the elastic mechanism adjusting member is in the first position, and the raised supporting face is mated with the bump when the elastic mechanism adjusting member is in the second position; and a shifter is formed on the lower base, and the elastic mechanism adjusting member is rotated between the first position and the second position by operating the shifter.

Alternatively, it is also possible that the elastic mechanism adjusting member comprises the upper base, wherein an upper surface of the upper base is formed with a raised supporting face and a recessed supporting face, a bump is formed at a lower portion of the pressing head, the recessed supporting face is mated with the bump when the elastic mechanism adjusting member is in the first position, and the raised supporting face is mated with the bump when the elastic mechanism adjusting member is in the second position; and a shifter is formed on the upper base, and the elastic mechanism adjusting member is rotated between the first position and the second position by operating the shifter.

In a second embodiment, the elastic mechanism comprises a lower base, wherein a lower surface of the lower base is formed with a raised supporting face and a recessed supporting face; the elastic mechanism adjusting member comprises the lower base and a relaxation ring, the relaxation ring is located between the lower base and the threaded sleeve, a bump is formed on the relaxation ring, the bump is mated with the recessed supporting face when the elastic mechanism adjusting member is in the first position, and the bump is in contact with the raised supporting face when the elastic mechanism adjusting member is in the second position; and the relaxation ring is further formed with at least one shifter, and the elastic mechanism adjusting member is rotated between the first position and the second position by operating the shifter.

Alternatively, it is also possible that the elastic mechanism comprises an upper base, wherein an upper surface of the upper base is formed with a raised supporting face and a recessed supporting face; the elastic mechanism adjusting member comprises the upper base and a relaxation ring, the relaxation ring is located between the upper base and the pressing head, a bump is formed on the relaxation ring, the bump is mated with the recessed supporting face when the elastic mechanism adjusting member is in the first position, and the bump is in contact with the raised supporting face when the elastic mechanism adjusting member is in the second position; and the relaxation ring is further formed with at least one shifter, and the elastic mechanism adjusting member is rotated between the first position and the second position by operating the shifter.

In a third embodiment, the elastic mechanism comprises a lower base, and the elastic mechanism adjusting member comprises a push plate provided between the lower base and the threaded sleeve, wherein the push plate comprises: two end plates located at two ends, and side plates extending between the end plates, and an upper surface of each of the side plates is formed in the shape of a step and comprises an upper step face and a lower step face; and the push plate is linearly movable between the first position in which the lower step faces are in contact with a supporting face of the lower base, and the second position in which the upper step faces are in contact with the supporting face of the lower base.

Further, a transition face is further comprised between the upper step face and the lower step face of the push plate, and the transition face is an inclined face or an arc-shaped face.

Preferably, the elastic mechanism adjusting member automatically moves between the first position and the second position. As an example:

in a fourth embodiment, the elastic mechanism adjusting member comprises a sleeve formed on the elastic mechanism, and at least one bump is formed on an inner surface of the sleeve; a guide groove is formed on an upper sleeve of the threaded sleeve, the bump is accommodated in the guide groove, and the guide groove comprises an upper inclined portion and a lower vertical portion; and the elastic mechanism comprises an upper base, wherein an upper surface of the upper base is formed with a raised platform and a recessed platform; and a pressing head bump is formed at a lower portion of the pressing head, wherein when the pressing head is at an upper dead point of a stroke of the pressing head, the sleeve is at the first position, and the recessed platform of the upper base is in contact with the pressing head bump; and the pressing head is pressed down so that the bump and the inclined portion of the guide groove interact with each other, such that the sleeve is rotated from the first position towards the second position, and when the bump enters the vertical portion, the sleeve rotates to the second position such that the raised platform of the upper base comes into contact with the pressing head bump.

In a fifth embodiment, the elastic mechanism adjusting member comprises a push plate provided between the elastic mechanism and the pressing head, wherein the push plate comprises a plate body and first and second cantilevers suspended downwardly from the plate body, and a lower surface of the plate body is formed in the shape of a step and comprises an upper step face and a lower step face; and an upper sleeve of the threaded sleeve is provided with: a first guide wedge, which corresponds to the first cantilever and has an inclined face facing upwardly; and a second guide wedge, which corresponds to the second cantilever and has an inclined face facing downwardly, wherein when the pressing head is at an upper dead point of a stroke, the push plate is in the first position in which the lower step face of the push plate is in contact with an upper base of the elastic mechanism such that the elastic strip is in the relaxed state; as the pressing head moves downwardly, the first cantilever comes into contact with and interacts with the first guide wedge to move the push plate from the first position to the second position in which the upper step face of the push plate is in contact with the upper base of the elastic mechanism such that the elastic strip is in the preloaded state; and as the pressing head moves upwardly, the second cantilever comes into contact with and interacts with the second guide wedge to return the push plate from the second position to the first position.

Preferably, a protruding claw is formed on a free end of the first cantilever and/or the second cantilever, and the protruding claw interacts with the first guide wedge and/or the second guide wedge.

In a sixth embodiment, the elastic mechanism adjusting member comprises a push plate provided between a lower base of the elastic mechanism and the threaded sleeve, wherein an upper surface of the push plate comprises an upper step face and a lower step face; and the piston rod is formed with: a first guide wedge comprising an inclined face facing downwardly; and a second guide wedge comprising an inclined face facing upwardly, wherein when the pressing head is at an upper dead point of a stroke, the push plate is in the first position in which the lower step face of the push plate is in contact with the lower base such that the elastic strip in the relaxed state; as the pressing head moves downwardly, the first guide wedge comes into contact with and interacts with the push plate to move the push plate from the first position to the second position in which the upper step face of the push plate is in contact with the lower base such that the elastic strip is preloaded; and as the pressing head moves upwardly, the second guide wedge comes into contact with and interacts with the push plate to return the push plate from the second position to the first position.

Preferably, a protrusion is formed on a lower surface of the lower base, and the protrusion is in contact with the upper step face or the lower step face of the push plate. In this way, the frictional resistance between the lower base and the push plate can be reduced, which facilitates the movement of the push plate between the first position and the second position.

The elastic mechanism may also be provided under the threaded sleeve, for example, inside the cylinder. As an example, in a seventh embodiment, the liquid pump is a press-type liquid pump, wherein the movable unit comprises a pressing head, the pressing head comprising a lower sleeve; the fixed unit comprises: a threaded sleeve; a cylinder connected to the threaded sleeve, a shoulder being formed in the cylinder; and a piston rod fixed inside the cylinder; and the elastic mechanism comprises an upper base and a lower base, the lower base abuts against the shoulder, and a relaxation ring is provided between the upper base and a lower end of the lower sleeve of the pressing head; a lower surface of the relaxation ring is formed with a raised supporting face and a recessed supporting face, wherein when the relaxation ring is in the first position, the recessed supporting face is in contact with the upper base, and the elastic strip is in the relaxed state; and when the relaxation ring is in the second position, the raised supporting face is in contact with the upper base, and the elastic strip is in the preloaded state; wherein at least one groove is formed on an inner surface of the relaxation ring, at least one guide rib is formed on the piston rod, the guide rib comprises an upper inclined portion and a lower vertical portion, the groove is mated with the guide rib, and when the groove is mated with the inclined portion, the downward movement of the pressing head causes the relaxation ring to rotate from the first position to the second position, and the upward movement of the pressing head causes the relaxation ring to rotate from the second position back to the first position.

Alternatively, the installation positions of the rib and the groove may be interchanged. As an example, at least one bump is formed on an inner surface of the relaxation ring, at least one guide groove is formed on the piston rod, the guide groove comprises an upper inclined portion and a lower vertical portion, the bump is mated in the guide groove, and when the bump is mated with the inclined portion, the downward movement of the pressing head causes the relaxation ring to rotate from the first position to the second position, and the upward movement of the pressing head causes the relaxation ring to rotate from the second position back to the first position.

The elastic strip can also be relaxed by inclining the elastic strip relative to a longitudinal axis of the liquid pump. As an example, the elastic mechanism comprises an upper base, and the elastic mechanism adjusting member comprises at least the upper base, wherein the upper base is linearly movable between the first position and the second position, the distance between two ends of the elastic strip is L1 when the upper base is in the first position, and the distance between the two ends of the elastic strip is L2 when the upper base is in the second position, where L1>L2.

Alternatively, a lower base of the elastic mechanism may be used as a linearly movable component, that is, the elastic mechanism adjusting member comprises at least the lower base, wherein the lower base is linearly movable between the first position and the second position, the distance between two ends of the elastic strip is L1 when the lower base is in the first position, and the distance between the two ends of the elastic strip is L2 when the lower base is in the second position, where L1>L2.

The liquid pump may also be a spray gun-type liquid pump, wherein the fixed unit comprises a cylinder, the movable unit comprises a piston rod, the piston rod is movably sleeved in the cylinder, and an actuation component is provided on the piston rod for actuating the movement of the piston rod relative to the cylinder; and the elastic mechanism comprises an elastic strip, a first end of the 5 elastic strip is fixed to the piston rod, and a second end of the elastic strip is fixed to the fixed unit, wherein the elastic mechanism adjusting member comprises a relaxation plate sleeved on the piston rod, the relaxation plate abuts against the first end of the elastic strip, a surface of the relaxation plate that faces the elastic mechanism is formed with a raised face and a recessed face, and the relaxation plate is rotatable between the first position in which the recessed face is in contact with the first end of the relaxation plate such that the elastic strip is in the relaxed state, and the second position in which the raised face is in contact with the first end of the relaxation plate such that the elastic strip is in the preloaded state.

The actuation component is a pivoting trigger. Alternatively, the actuation component is a pressing portion mounted coaxially on the piston rod.

DETAILED DESCRIPTION OF EMBODIMENTS

Figure 1A:
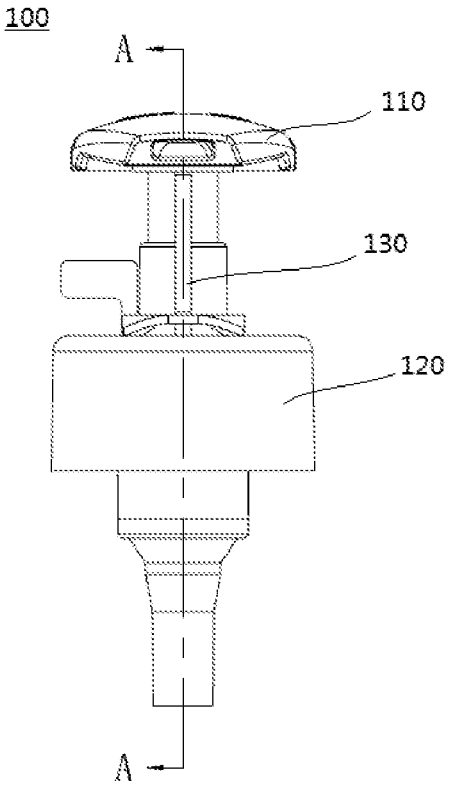
FIG. 1*a* is a front view of a liquid pump of a first embodiment of the present invention.
Figure 1B:
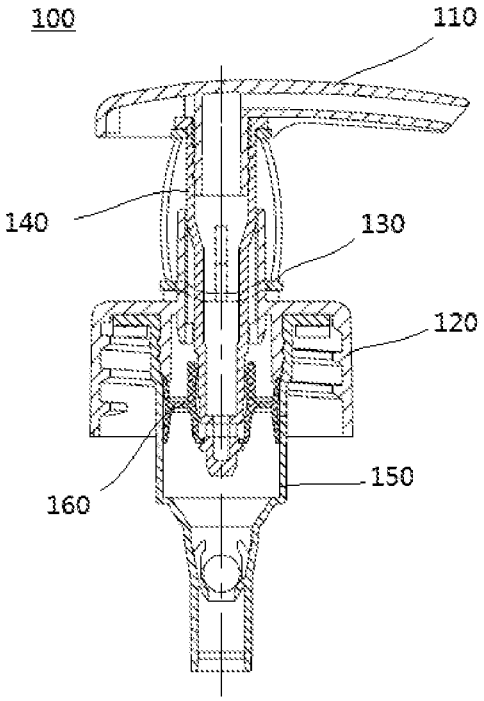
FIG. 1*b* is a cross-sectional view of the liquid pump taken along line A-A in FIG. 1*a*, with the liquid pump being in an unpressed state.
Figure 1C:
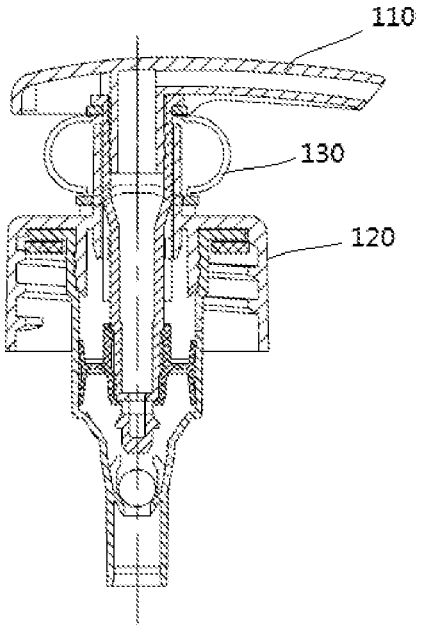
FIG. 1*c* is another cross-sectional view of the liquid pump shown in FIG. 1*a*, with the liquid pump being in a depressed state.

In order to facilitate the understanding of the present invention, specific embodiments of the present invention will be described below with reference to the accompanying drawings. It should be appreciated that only preferred embodiments of the present invention are shown in the accompanying drawings and are not intended to constitute a limitation to the scope of the present invention. Various obvious modifications, variations and equivalent substitutions of the present invention can be made by those skilled in the art based on the embodiments shown in the drawings, and the technical features in the various embodiments described below can be arbitrarily combined without causing contradictions. These all fall within the scope of protection of the present invention.

It should be noted here that unless otherwise specifically explained, the orientation terms such as "upper" and "lower" used herein are described with reference to the vertical orientation of the liquid pump in use.

First Embodiment

FIGS. 1*a* to 3*c* show a liquid pump 100 of a first embodiment of the present invention. The type of the liquid pump 100 is a press pump. FIG. 1*a* shows a front view of the liquid pump 100. FIG. 1*b* shows a cross-sectional view taken along line A-A in FIG. 1*a*, with the liquid pump 100 being in an unpressed state. FIG. 1*b* is a cross-sectional view of the liquid pump 100 in a pressed state.

As shown in FIG. 1*a*, a liquid pump 100 in the form of a press pump comprises a pressing head 110 and a threaded sleeve 120, and an elastic mechanism 130 is provided between the pressing head 110 and the threaded sleeve 120. The elastic mechanism 130 is made of a non-metallic material with elasticity, such as elastic plastic and rubber. A piston rod 140 is connected under the pressing head 110, a piston 160 is installed at a lower end of the piston rod 140, and the threaded sleeve 120 and a cylinder 150 are connected together. The piston rod 140 passes through an opening at an upper end of the threaded sleeve 120 into the interior of the threaded sleeve 120, and extends into the cylinder 150.

When using the liquid pump 100, a user applies a downward pressing force on the pressing head 110, such that the pressing head 110 and the piston rod 140 connected to the pressing head 110 move downwardly against an elastic force from the elastic mechanism 130, thereby pumping a product material liquid out of the cylinder 150. After one time of pumping, the pressing force applied to the pressing head 110 is removed, and the pressing head 110 and the piston rod 140 return upwardly to a standby position under the action of the elastic force from the elastic mechanism 130. In this way, during the reciprocating movement of the pressing head 110, the product is pumped out.

In the present invention, the elastic mechanism 130 is made of an elastic material such as plastic and can be switched between a first position and a second position. In the first position, the elastic mechanism 130 is in an unloaded, relaxed state, whereas in the second position, the elastic mechanism 130 is in a preloaded state.

Figure 2A:
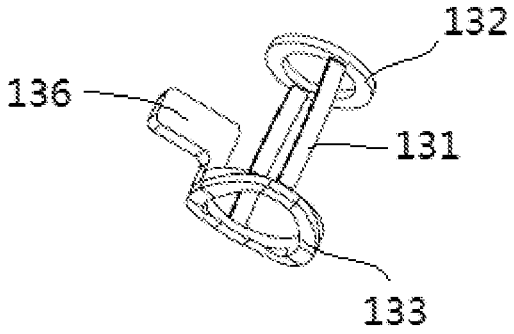
FIG. 2*a* is a perspective view of an elastic mechanism in the liquid pump of the first embodiment.
Figure 2B:
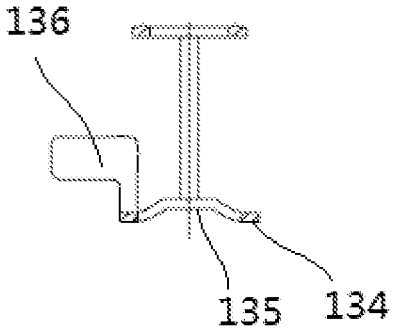
FIG. 2*b* is a cross-sectional view of the elastic mechanism shown in FIG. 2*a*.
Figure 2C:
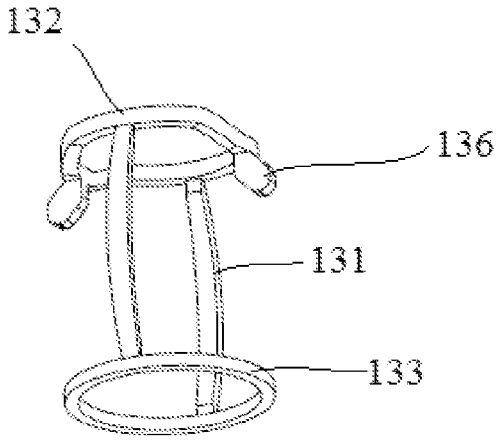
FIG. 2*c* is a perspective view of an alternative elastic mechanism in the liquid pump with the shifter provided on the upper base.
Figure 2D:
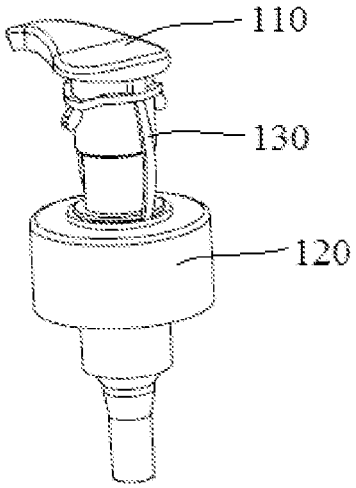
FIG. 2*d* shows a liquid pump mounted with the elastic mechanism shown in FIG. 2*c*.

Specifically, as shown in FIGS. 2*a* and 2*b*, the elastic mechanism 130 comprises at least one, preferably two or more elastic strips 131. Preferably, in an unstressed state, the elastic strip 131 is arc-shaped so that the situation where a too large downward-pressing force is required at an upper dead point of a stroke of the pressing head 110 will not occur.

An upper base 132 and a lower base 133 are respectively connected to two ends of the elastic strip 131, and the upper base 132 and the lower base 133 are ring-shaped. In an installed state, the upper base 132 is sleeved on a lower sleeve of the pressing head 110 and abuts against the pressing head 110 in a relatively rotatable manner, and the lower base 133 is sleeved on an upper sleeve of the threaded sleeve 120 and abuts against the threaded sleeve 120 in a relatively rotatable manner, such that a biasing force is applied between the pressing head 110 and the threaded sleeve 120 for restoring the pressing head 110 relative to the threaded sleeve 120.

Figure 3A:
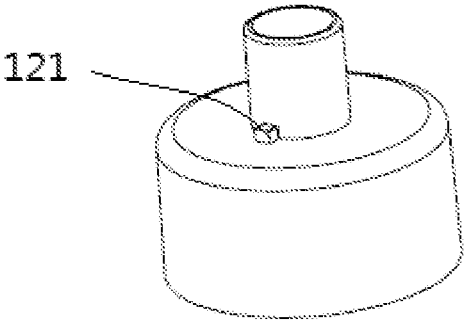
FIG. 3*a* is a perspective view of a threaded sleeve in the liquid pump of the first embodiment.
Figure 3B:
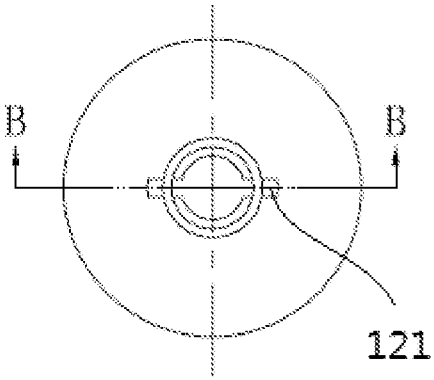
FIG. 3*b* is a top view of the threaded sleeve shown in FIG. 3*a*.
Figure 3C:
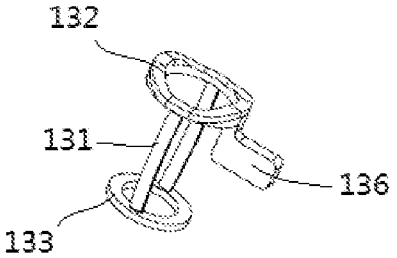
FIG. 3*c* is a cross-sectional view taken along line B-B in FIG. 3*b*.
Figure 3C:
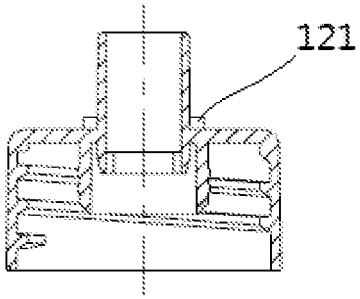

A lower surface of the lower base 133 comprises a raised supporting face 134 and a recessed supporting face 135. Correspondingly, as shown in FIGS. 3*a* to 3*c*, at least one bump 121 (two bumps shown in the figures) is provided on the threaded sleeve 120. When the elastic mechanism 130 is in the first position, the recessed supporting face 135 is mated with the bump 121, and in this case, the distance between the upper base 132 and the lower base 133 is a larger distance H1; whereas in the second position, the raised supporting face 134 is in contact with the bump 121, such that the distance between the upper base 132 and the lower base 133 is shortened to a smaller distance H2, and the elastic strip 131 of the elastic mechanism 130 is preloaded in this case.

Further, as shown in FIGS. 2*a* and 2*b*, a shifter 136 is further provided on the elastic mechanism 130, for example, a shifter 136 is provided on the lower base 133 as shown in the figures. The user can operate the shifter 136 to rotate the elastic mechanism 130 between the first position and the second position, thereby switching the elastic strip 131 of the elastic mechanism 130 between the relaxed state and the preloaded state.

The operation principle of the liquid pump 100 of the above structure will be described below.

When the liquid pump 100 is not in use, the elastic mechanism 130 is in the first position, and at this time, the recessed supporting face 135 of the lower base 133 of the elastic mechanism 130 is opposite the bump 121 on the threaded sleeve 120. In this case, the distance between the upper base 132 and the lower base 133 of the elastic mechanism 130 is relatively large, such that the elastic strip 131 is in the relaxed state.

When the liquid pump 100 needs to be used, the shifter 136 is operated to drive the elastic mechanism 130 from the first position to the second position relative to the pressing head 110 and/or the threaded sleeve 120. In this case, the raised supporting face 134 of the lower base 133 of the elastic mechanism 130 is in contact with the bump 121 to raise the lower base 133, such that the distance between the upper base 132 and the lower base 133 is shortened, and the elastic strip 131 undergoes preloading.

After the use is completed, the shifter 136 is operated to rotate the elastic mechanism 130 from the second position back to the first position, such that the elastic strip 131 returns from the preloaded state to the relaxed state.

In the liquid pump 100 of the above structure, when the liquid pump 100 is in use, the elastic strip 131 of the elastic mechanism 130 is in the preloaded state, and when the liquid pump 100 is not in use, the elastic strip 131 is in the relaxed state. Therefore, it can be ensured the elastic mechanism 130 has a sufficient elastic force when in use, and the relaxed state of the elastic strip 131 when not in use can avoid the yielding deformation of the elastic strip 131 due to long-term stress, prolonging the service life thereof.

In the above structure, the elastic strip 131 is relaxed and preloaded by causing the raised supporting face 134 and the recessed supporting face 135 of the lower base 133 to alternately mate with and come into contact with the bump 121 on the threaded sleeve 120. As an alternative or additional structure, it is also possible that an upper surface of the upper base 132 is formed with a raised supporting face and a recessed supporting face, and a matching protrusion may be formed at a lower portion of the pressing head 110.

Second Embodiment

FIGS. 4*a* to 6*c* show a liquid pump 200 of a second embodiment of the present invention. In the following description of the second embodiment, for the sake of brevity, the features that are not included in the first embodiment are mainly described, and the same technical features as those of the first embodiment will not be described in detail.

Figure 4A:
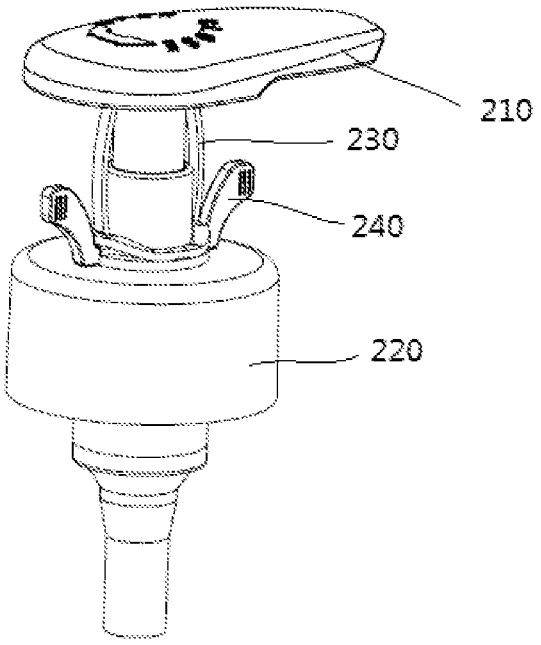
FIG. 4*a* is a perspective view of a liquid pump of a second embodiment of the present invention.
Figure 4B:
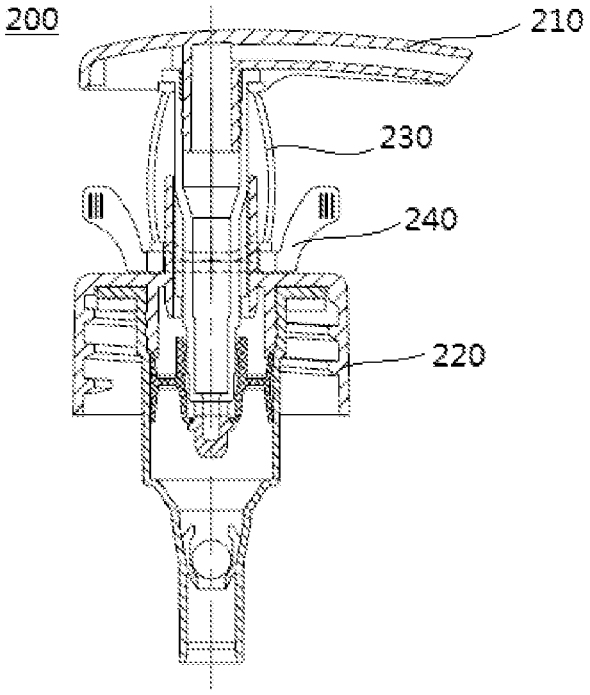
FIG. 4*b* is a cross-sectional view of the liquid pump shown in FIG. 4*a*, with the liquid pump being in an unpressed state.
Figure 4C:
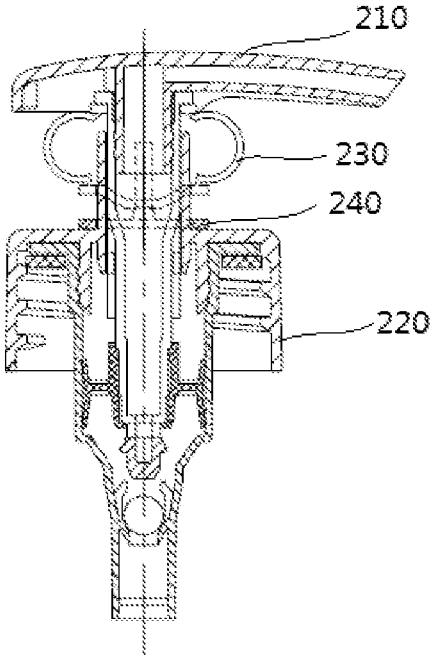
FIG. 4*c* is another cross-sectional view of the liquid pump shown in FIG. 4*a*, with the liquid pump being in a depressed state.

As shown in FIGS. 4*a* to 4*c*, the liquid pump 200 comprises a pressing head 210, a threaded sleeve 220 and an elastic mechanism 230.

Figure 5A:
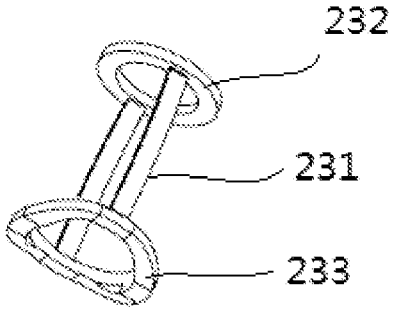
FIG. 5*a* is a perspective view of an elastic mechanism in the liquid pump of the second embodiment.
Figure 5B:
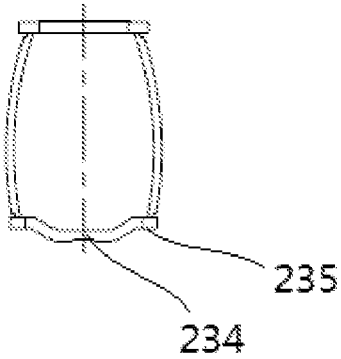
FIG. 5*b* is a cross-sectional view of the elastic mechanism shown in FIG. 5*a*.

As shown in FIGS. 5*a* and 5*b*, the elastic mechanism 230 comprises an upper base 232, a lower base 233, and at least one elastic strip 231 connected between the upper base 232 and the lower base 233. The upper base 232 and the lower base 233 are ring-shaped. A lower surface of the lower base 233 of the elastic mechanism 230 comprises a raised supporting face 234 and a recessed supporting face 235.

Figure 6A:
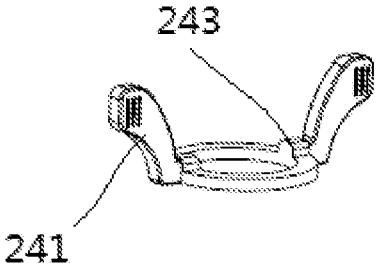
FIG. 6*a* is a perspective view of a relaxation ring in the liquid pump of the second embodiment.
Figure 6B:
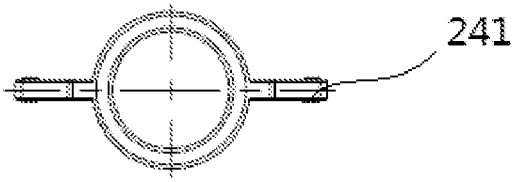
FIG. 6*b* is a bottom view of the relaxation ring shown in FIG. 6*a*.
Figure 6C:
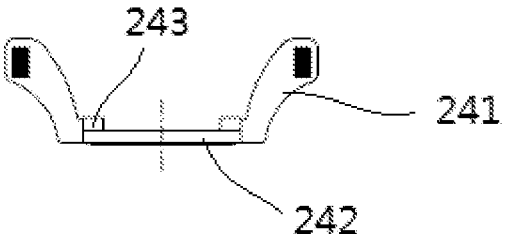
FIG. 6*c* is a side view of the relaxation ring shown in FIG. 6*a*.

The liquid pump 200 of the second embodiment is different from the liquid pump 100 of the first embodiment in that the liquid pump 200 further comprises a relaxation ring 240. As shown in FIGS. 6*a* to 6*c*, the relaxation ring 240 comprises an annular supporting seat 242, and at least one shifter 241 (two shifters 241 shown in the figures) is provided on the supporting seat 242. Moreover, at least one, preferably two or more bumps 243 are formed on a surface of the supporting seat 242 that faces the elastic mechanism 230.

Referring back to FIGS. 4*a* to 4*c*, the upper base 232 of the elastic mechanism 230 abuts against the pressing head 210, and the relaxation ring 240 is interposed between the lower base 233 of the elastic mechanism 230 and the threaded sleeve 220. The relaxation ring 240 can rotate between the first position and the second position. In the first position, the bump 243 on the supporting seat 242 of the relaxation ring 240 corresponds to the recessed supporting face 235 of the lower base 233 of the elastic mechanism 230, such that the distance between the upper base 232 and the lower base 233 of the elastic mechanism 230 is relatively large, and the elastic strip 231 is in the relaxed state. In the second position, the bump 243 on the supporting seat 242 of the relaxation ring 240 is in contact with the raised supporting face 234 of the lower base 233 of the elastic mechanism 230 to raise the lower base 233, such that the distance between the upper base 232 and the lower base 233 of the elastic mechanism 230 is reduced, and the elastic strip 231 is preloaded.

Similar to the first embodiment, it is also possible that an upper surface of the upper base 232 is provided with a raised supporting face and a recessed supporting face, and the relaxation ring 240 is provided between the upper base 232 and the pressing head 210.

The operation principle of the liquid pump 200 of the above structure will be described below.

When the liquid pump 200 is not in use, the relaxation ring 240 is in the first position, and at this time, the position of the bump 243 on the supporting seat 242 of the relaxation ring 240 corresponds to the recessed supporting face 235 of the lower base 233 of the elastic mechanism 230, such that the elastic strip 231 is in the relaxed state.

When the liquid pump 200 needs to be used, a user can operate the shifter 241 of the relaxation ring 240 to rotate the relaxation ring 240 from the first position to the second position, such that the bump 243 of the relaxation ring 240 comes into contact with the raised supporting face 234 of the lower base 233 of the elastic mechanism 230 to raise the lower base 233, and the elastic strip 231 is thus in the preloaded state.

After the use of the liquid pump 200 is completed, the user operates the shifter 241 of the relaxation ring 240 again to rotate the relaxation ring 240 from the second position back to the first position, such that the position of the bump 243 of the relaxation ring 240 corresponds to the recessed supporting face 235 again, and the elastic strip 231 returns to the relaxed state.

Third Embodiment

FIGS. 7*a* to 9*c* show a liquid pump 300 of a third embodiment of the present invention. In the following description of the third embodiment, for the sake of brevity, the features that are not included in the previous embodiments are mainly described, and the same technical features as those of the previous embodiments will not be described in detail.

Figure 7A:
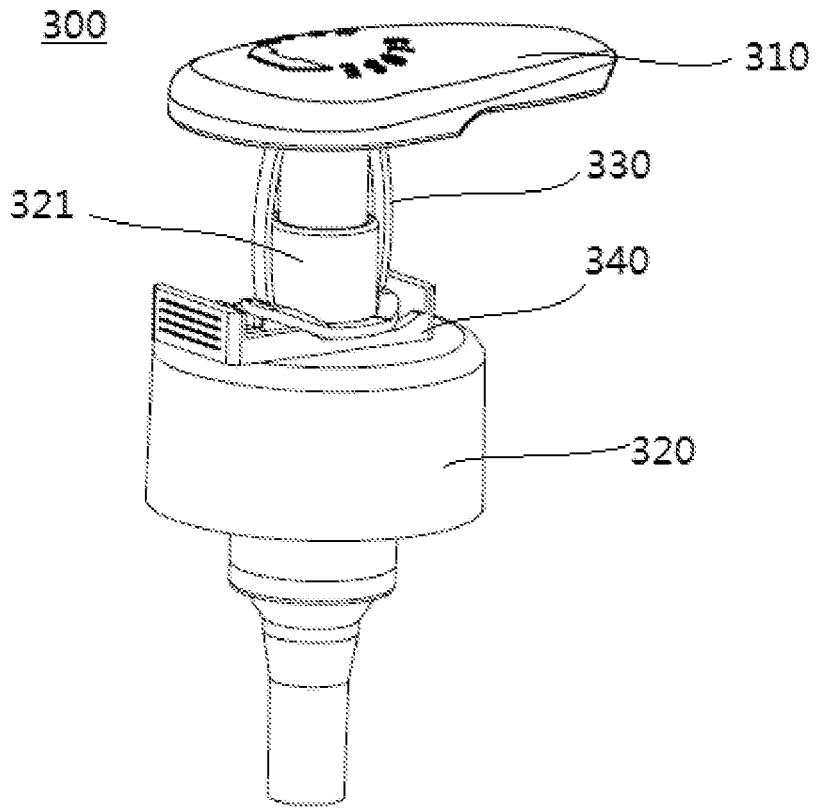
FIG. 7*a* is a perspective view of a liquid pump of a third embodiment of the present invention.
Figure 7B:
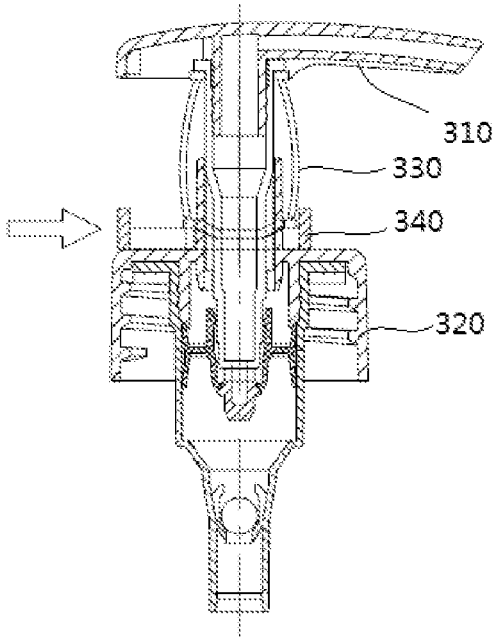
FIG. 7*b* is a cross-sectional view of the liquid pump shown in FIG. 7*a*, with the liquid pump being in an unpressed state.
Figure 7C:
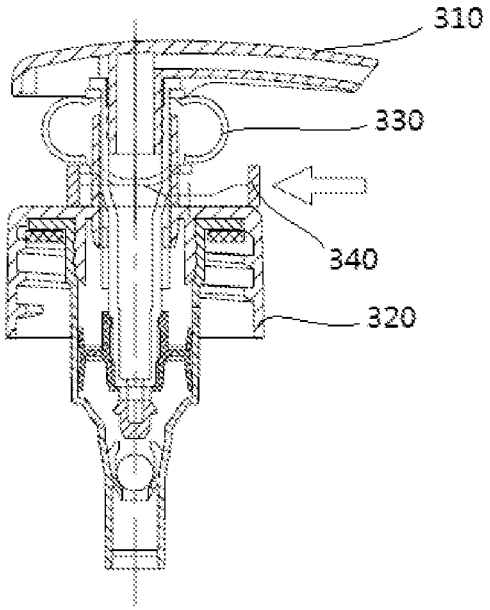
FIG. 7*c* is another cross-sectional view of the liquid pump shown in FIG. 7*a*, with the liquid pump being in a depressed state.
Figure 8A:
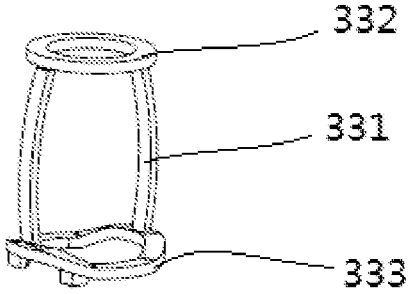
FIG. 8*a* is a perspective view of an elastic mechanism in the liquid pump of the third embodiment.
Figure 8B:
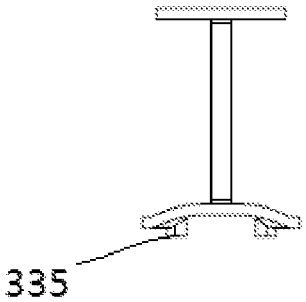
FIG. 8*b* is a front view of the elastic mechanism shown in FIG. 8*a*.
Figure 8C:
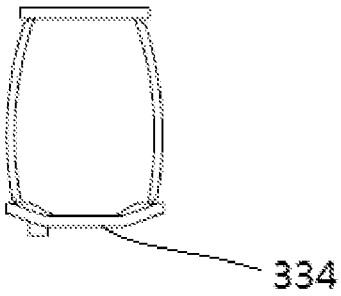
FIG. 8*c* is a side view of the elastic mechanism shown in FIG. 8*a*.

As shown in FIGS. 7*a* to 7*c*, the liquid pump 300 comprises a pressing head 310, a threaded sleeve 320 and an elastic mechanism 330. The elastic mechanism 330 comprises an upper base 332, a lower base 333, and at least one elastic strip 331 connected between the upper base 332 and the lower base 333 (see FIGS. 8*a* to 8*c*).

The liquid pump 300 of the third embodiment differs from the previous embodiments in that the upper base 332 abuts against the pressing head 310, and a push plate 340 interposed between the lower base 333 of the elastic mechanism 330 and the threaded sleeve 320 is in the form of a push component.

Figure 9A:
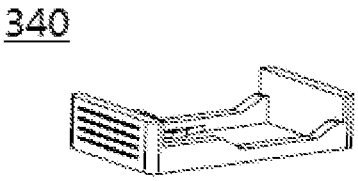
FIG. 9*a* is a perspective view of a push plate in the liquid pump of the third embodiment.
Figure 9B:
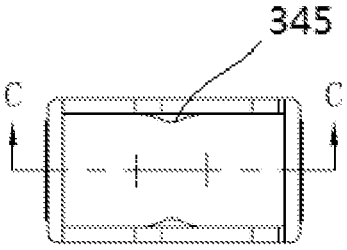
FIG. 9*b* is a top view of the push plate shown in FIG. 9*a*.
Figure 9C:
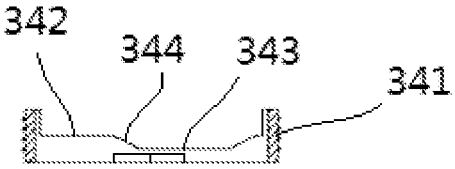
FIG. 9*c* is a cross-sectional view taken along line C-C in FIG. 9*b*.

As shown in FIGS. 9*a* to 9*c*, the push plate 340 in the form of a push component comprises end plates 341 at two ends and two side plates connected between the two end plates 341, such that the push plate 340 is formed in the shape of a rectangular ring. The rectangular ring sleeve may be sleeved on an upper sleeve of the threaded sleeve 320, for example.

An upper surface of each of the side plates is in the shape of a step, and comprises an upper step face 342 and a lower step face 343. Between the upper step face 342 and the lower step face 343 is a transition face 344 in the form of an inclined face. The push plate 340 can move linearly between the first position and the second position. In the first position, a supporting face 334 of a lower surface of the lower base 333 of the elastic mechanism 330 is in contact with the lower step faces 343, such that the distance between the upper base 332 and the lower base 333 is relatively large, and the elastic strip 331 of the elastic mechanism 330 is in the relaxed state. In the second position, the supporting face 334 of the elastic mechanism 330 is in contact with the upper step face 342, the distance between the upper base 332 and the lower base 333 of the elastic mechanism 330 is relatively small, and the elastic strip 331 of the elastic mechanism 330 is in the preloaded state.

Preferably, protrusions 345 are respectively formed on the inner sides of the two side plates, and the distance between the two protrusions 345 is smaller than the diameter of an upper sleeve 321 of the threaded sleeve 320. In this way, the protrusions 345 have a limiting function. When the push plate 340 is in the first position or the second position, the protrusions 345 are on one side of the upper sleeve 321 of the threaded sleeve 320 and are not in contact with the upper sleeve 321. When the push plate 340 is to be pushed from the first position to the second position or from the second position to the first position, the protrusion 345 will come into contact the upper sleeve 321 to prevent further movement of the push plate 340. In this case, a force greater than a predetermined value needs to be applied to deform the two side plates of the push plate 340, to allow the protrusions 345 to pass over the upper sleeve 321. In this way, with the provision of the protrusions 345, it is necessary to apply a force above a predetermined value to linearly move the push plate 340 between the first position and the second position, thereby avoiding the incorrect operation of the push plate 340.

In addition, preferably, guide bumps 335 are provided on the supporting face 334 of the elastic mechanism 330. When the push plate 340 is in the first position, the guide protrusions 335 are mated with the upper step faces 342. During the movement of the push plate 340 from the first position to the second position, the guide protrusions 335 guide the movement of the supporting face 334 from the lower step faces 343 to the upper step faces 342.

The operation principle of the liquid pump 300 of the above structure will be described below.

When the liquid pump 300 is not in use, the push plate 340 is in the first position, and at this time, the lower step faces 343 of the side plates of the push plate 340 are in contact with the supporting face 334 of the lower base 333 of the elastic mechanism 330, and the elastic strip 331 is in the relaxed state.

When the liquid pump 300 needs to be used, the user pushes the end plate 341 at one end of the push plate 340 to linearly move the push plate 340 from the first position towards the second position. As a result, the supporting face 334 of the elastic mechanism 330 is in contact with the upper step faces 342 to raise the lower base 333 and shorten the distance between the upper base 332 and the lower base 333, such that the elastic strip 331 is in the preloaded state.

After the use of the elastic mechanism 330 is completed, the end plate 341 at the other end of the push plate 340 is pushed to linearly move the push plate 340 from the second position to the first position. In this way, the supporting face 334 of the elastic mechanism 330 comes into contact with the lower step faces 343 and returns to the relaxed state.

Fourth Embodiment

FIGS. 10*a* to 13*b* show a liquid pump 400 of a fourth embodiment of the present invention. In the following description of the fourth embodiment, for the sake of brevity, the features that are not included in the previous embodiments are mainly described, and the same technical features as those of the previous embodiments will not be described in detail.

Figure 10A:
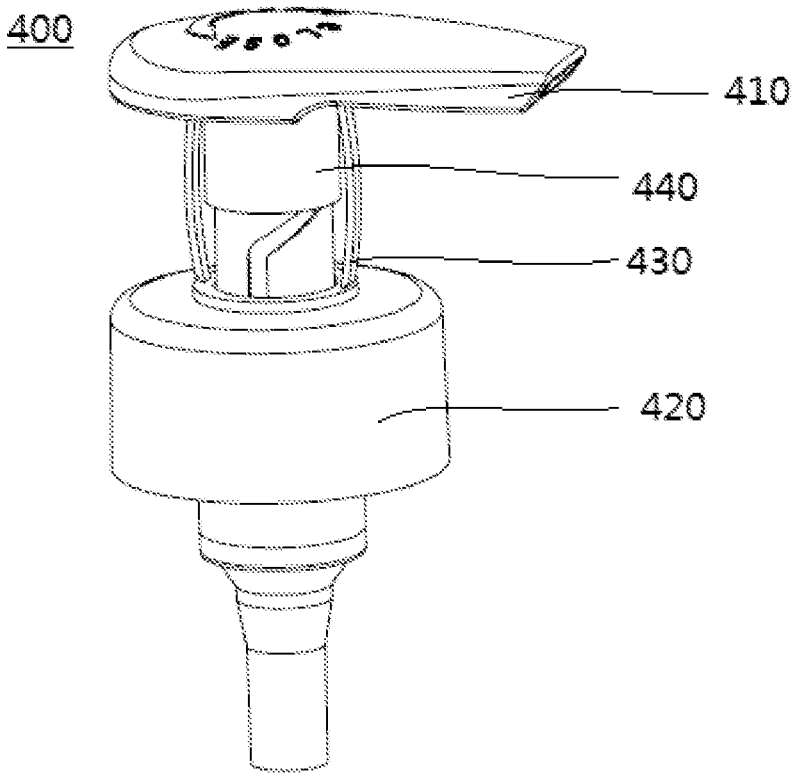
FIG. 10*a* is a perspective view of a liquid pump of a fourth embodiment of the present invention.
Figure 10B:
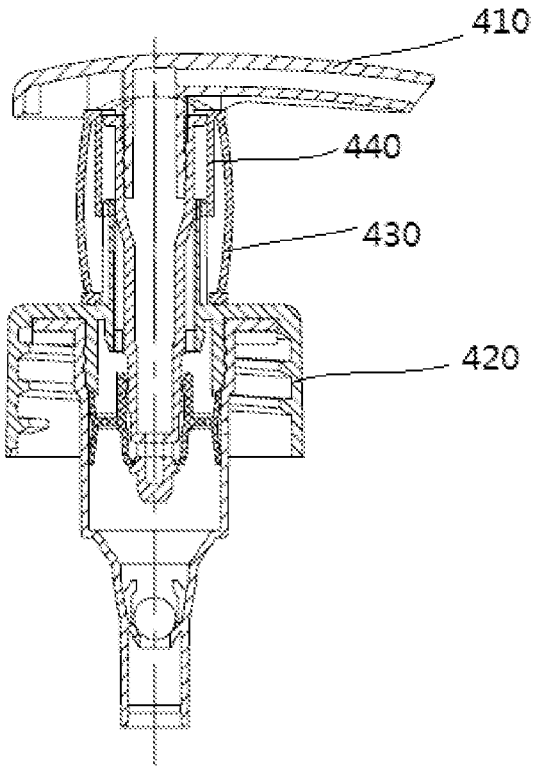
FIG. 10*b* is a cross-sectional view of the liquid pump shown in FIG. 10*a*, with the liquid pump being in an unpressed state.
Figure 10C:
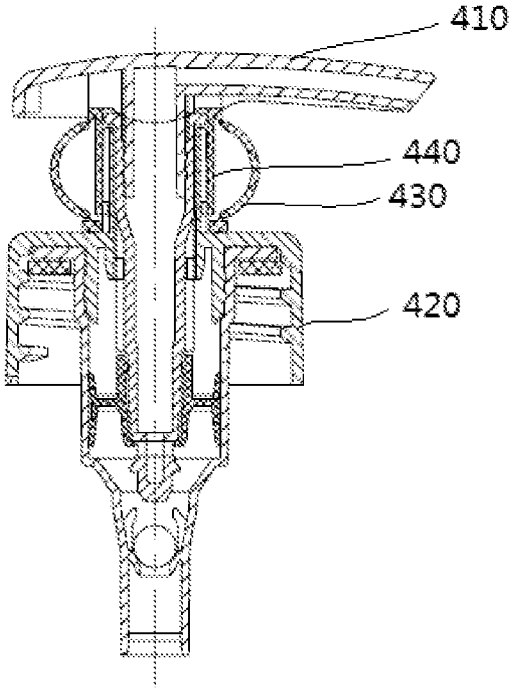
FIG. 10*c* is another cross-sectional view of the liquid pump shown in FIG. 10*a*, with the liquid pump being in a depressed state.

As shown in FIGS. 10*a* to 10*c*, the liquid pump 400 of the fourth embodiment comprises a pressing head 410, a threaded sleeve 420, and an elastic mechanism 430 provided between the pressing head 410 and the threaded sleeve 420. In the fourth embodiment, a sleeve 440 is further comprised. The sleeve may be integrally or detachably formed on the elastic mechanism 430, for example.

Figure 11A:
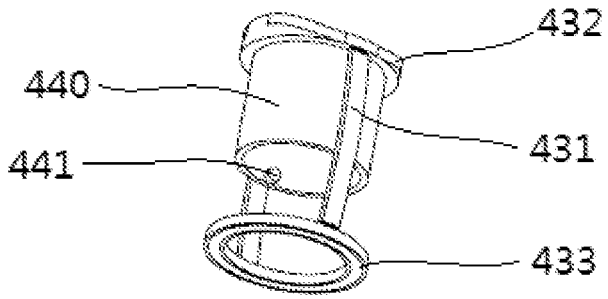
FIG. 11*a* is a perspective view of an elastic mechanism in the liquid pump of the fourth embodiment, with the elastic mechanism being provided with a sleeve.
Figure 11B:
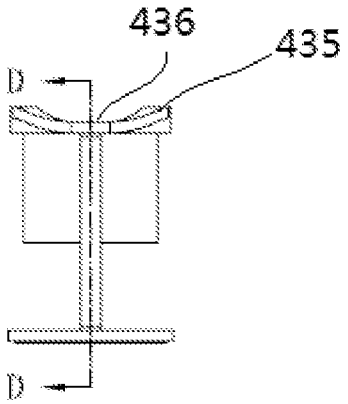
FIG. 11*b* is a front view of the elastic mechanism shown in FIG. 11*a*.
Figure 11C:
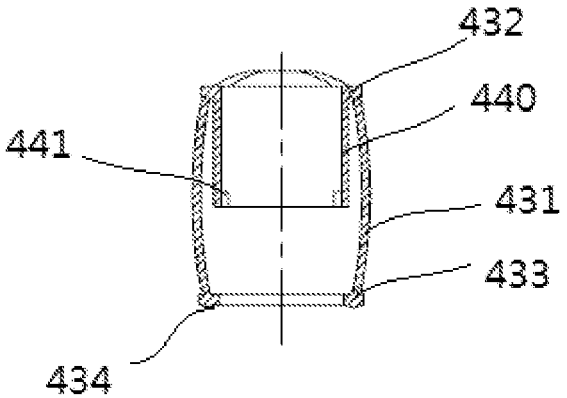
FIG. 11*c* is a cross-sectional view taken along line D-D in FIG. 11*b*.
Figure 12A:
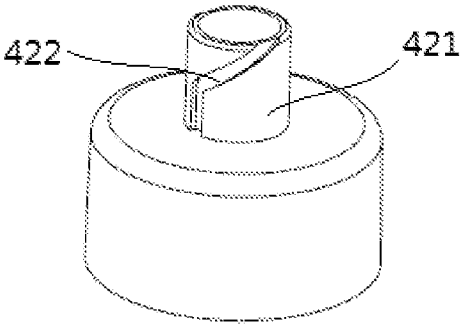
FIG. 12*a* is a perspective view of a threaded sleeve in the liquid pump of the fourth embodiment.
Figure 12B:
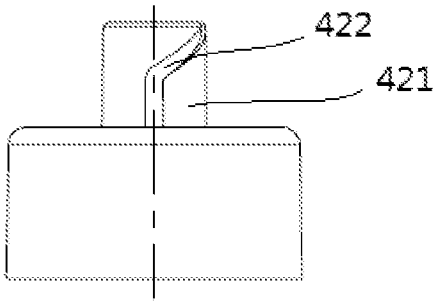
FIG. 12*b* is a front view of the threaded sleeve shown in FIG. 12*a*.
Figure 13A:
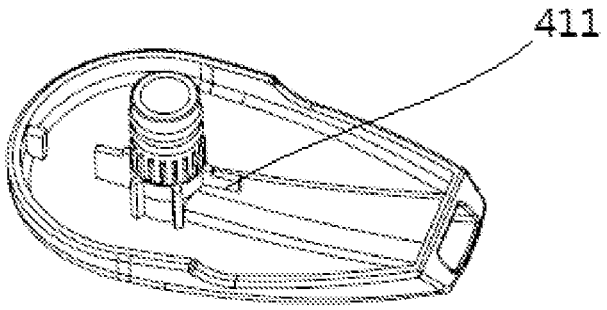
FIG. 13*a* is a bottom perspective view of a pressing head of the liquid pump of the fourth embodiment.
Figure 13B:
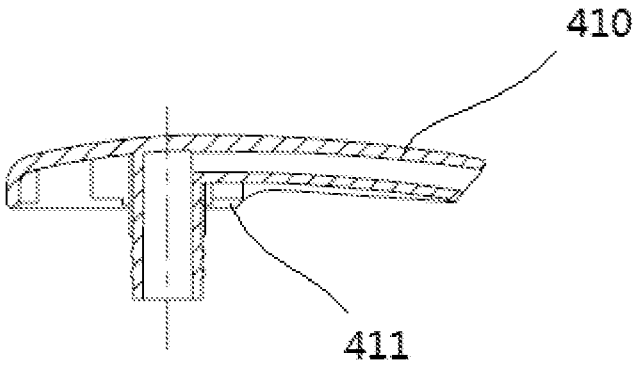
FIG. 13*b* is a cross-sectional view of the pressing head shown in FIG. 13*a*.

As shown in FIGS. 11*a* to 11*c*, the elastic mechanism 430 comprises an upper base 432, a lower base 433, and at least one elastic strip 431 connected between the upper base 432 and the lower base 433. An upper surface of the upper base 432 comprises a raised platform 435 and a recessed platform 436. Correspondingly, a pressing head bump 411 is formed at a lower portion of the pressing head 410 (see FIGS. 13*a* and 13*b*). The elastic mechanism 430 can rotate between the first position and the second position. In the first position, the recessed platform 436 is in contact with the pressing head bump 411, such that the distance between the upper base 432 and the lower base 433 is relatively large, and the elastic strip 431 is in the relaxed state. In the second position, the raised platform 435 is in contact with the pressing head bump 411, such that the distance between the upper base 432 and the lower base 433 is relatively small, and the elastic strip 431 is in the preloaded state.

In the fourth embodiment of the present invention, the elastic mechanism 430 can be automatically switched from the first position to the second position while the user presses the pressing head 410. This automatic switching structure is as follows.

As shown in FIGS. 11*a* and 11*c*, a sleeve 440 extending downwardly is formed on the upper base 432, and at least one bump 441 is formed inside the sleeve 440. Correspondingly, a guide groove 422 is formed on an upper sleeve 421 of the threaded sleeve 420. An upper portion of the guide groove 422 is an inclined groove, and a lower portion thereof is a vertical groove. In the installed state, the bump 441 is mated in the guide groove 422. When the pressing head 410 is pressed down, the sleeve 440 formed on the upper base 432 also descends, and when the bump 441 is in the inclined groove portion of the guide groove 422, the elastic mechanism 430 rotates from the first position towards the second position under the interaction between the bump 441 and the guide groove 422. When the bump 441 enters the vertical groove portion of the guide groove 422, the elastic mechanism 430 reaches the second position, such that the elastic mechanism 430 enters the preloaded state.

Preferably, a rib 434 is formed on a lower surface of the lower base 433 of the elastic mechanism 430, and the rib 434 is used to come into contact with the threaded sleeve 420, thereby reducing the resistance of the elastic mechanism 430 when rotating relative to the threaded sleeve 420.

The operation principle of the liquid pump 400 of the above structure will be described below.

When the liquid pump 400 is not in use, the elastic mechanism 430 is in the first position, and the recessed platform 436 of the upper base 432 of the elastic mechanism 430 is in contact with the pressing head bump 411 of the pressing head 410, such that the elastic strip 431 is in the relaxed state.

When the user uses the liquid pump 400, a downward pressing force is applied to the pressing head 410 to move the pressing head 410 downwardly, and the sleeve 440 also moves downwardly therewith. In this case, the protrusion 441 in the sleeve 440 moves in the inclined groove portion in the guide groove 422, such that the elastic mechanism 430 rotates from the first position towards the second position.

The pressing head 410 continues to be pressed downwardly such that the bump 441 enters the vertical groove portion in the guide groove 422. In this case, the elastic mechanism 430 rotates to the second position, and the raised platform 435 of the upper base 432 of the elastic mechanism 430 is in contact with the pressing head bump 411 of the pressing head 410, such that the elastic strip 431 is changed into the preloaded state.

After the use is completed, the user removes the pressing force from the pressing head 410, and the pressing head 410 moves upwardly under the action of the elastic force from the elastic strip 431 of the elastic mechanism 430. As the pressing head 410 moves upwardly, the bump 441 of the sleeve 440 moves from the vertical groove portion of the guide groove 422 to the inclined groove portion, and the elastic mechanism 430 then rotates from the second position back to the first position under the action between the guide groove 422 and the bump 441, such that the elastic strip 431 returns to the relaxed state.

Fifth Embodiment

FIGS. 14*a* to 16*b* show a liquid pump 500 of a fifth embodiment of the present invention. In the following description of the fifth embodiment, for the sake of brevity, the features that are not included in the previous embodiments are mainly described, and the same technical features as those of the previous embodiments will not be described in detail.

Figure 14A:
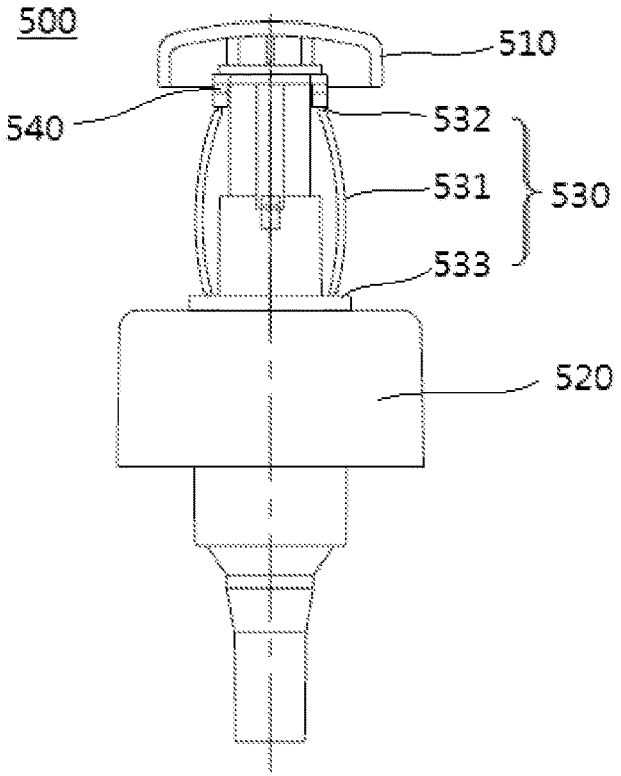
FIG. 14*a* is a front view of a liquid pump of a fifth embodiment of the present invention.
Figure 14B:
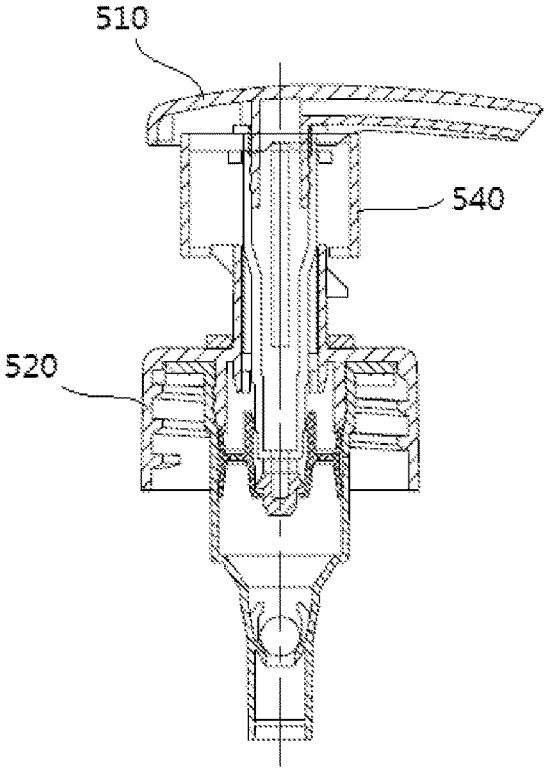
FIG. 14*b* is a cross-sectional view of the liquid pump shown in FIG. 14*a*, with the liquid pump being in an unpressed state.
Figure 14C:
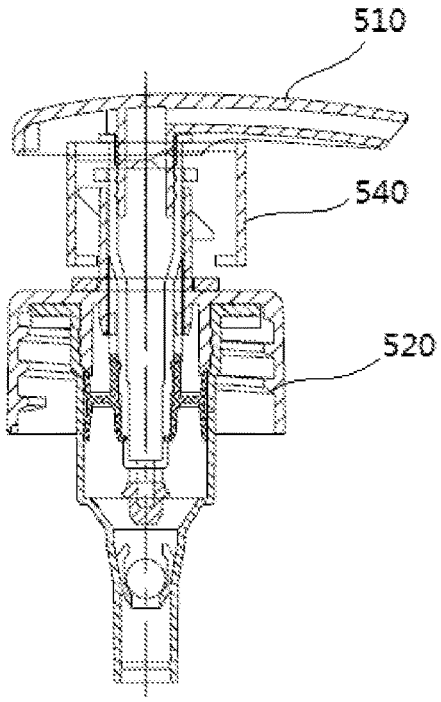
FIG. 14*c* is another cross-sectional view of the liquid pump shown in FIG. 14*a*, with the liquid pump being in a depressed state.

As shown in FIGS. 14*a* to 14*c*, the liquid pump 500 comprises a pressing head 510, a threaded sleeve 520, and an elastic mechanism 530 provided between the pressing head 510 and the threaded sleeve 520. The liquid pump 500 of the fifth embodiment further comprises a relaxation push plate 540. The relaxation push plate 540 is arranged between the upper base 532 of the elastic mechanism 530. The lower base 533 of the elastic mechanism 530 abuts against the threaded sleeve 520.

Figure 15A:
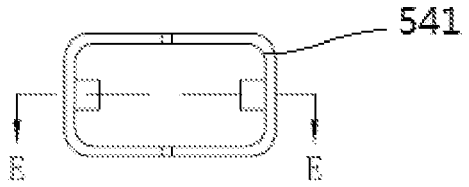
FIG. 15*a* is a top view of a push plate of the liquid pump of the fifth embodiment.
Figure 15B:
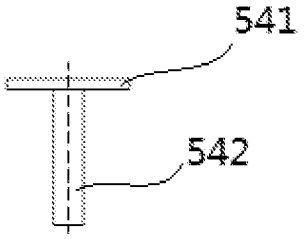
FIG. 15*b* is a side view of the push plate shown in FIG. 15*a*.
Figure 15C:
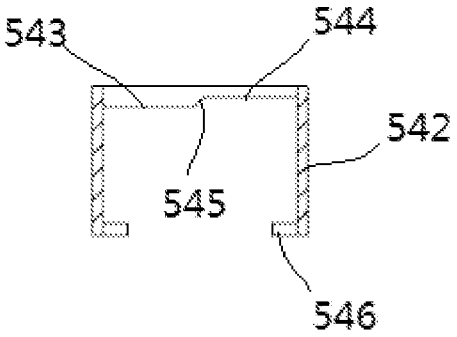
FIG. 15*c* is a cross-sectional view taken along line E-E in FIG. 15*a*.

FIGS. 15*a* to 15*c* show the relaxation push plate 540, wherein the relaxation push plate 540 comprises a plate body 541 in the shape of a rectangular ring and cantilevers 542 suspended downwardly from the plate body 541. For example, in the structure shown in FIG. 15*a*, the relaxation push plate 540 is formed with two cantilevers 542 arranged opposite each other. As shown more clearly in FIG. 15*c*, two side walls of the plate body 541 are respectively formed in the shape of a step, a lower surface of each of the side walls comprises an upper step face 543 and a lower step face 544, and a transition face 545 is between the upper step face 543 and the lower step face 544. The transition face 545 is formed in the form of an inclined face in the figure. Of course, the transition face 545 may also be formed as an arc-shaped face.

The relaxation push plate 540 can move linearly between the first position and the second position. When the relaxation push plate 540 is in the first position, the lower step faces 544 are in contact with the upper base 532 of the elastic mechanism 530, such that the distance between the upper base 532 and the lower base 533 is relatively large, and the elastic strip 531 of the elastic mechanism 530 is in the relaxed state. When the relaxation push plate 540 is in the second position, the upper step faces 543 are in contact with the upper base 532 of the elastic mechanism 530, such that the distance between the upper base 532 and the lower base 533 becomes smaller, and the elastic strip 531 is thus preloaded.

Figure 16A:
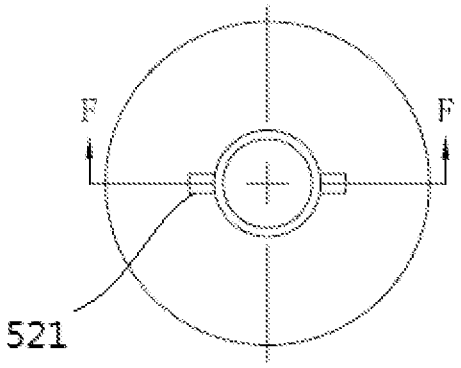
FIG. 16*a* is a top view of a threaded sleeve of the liquid pump of the fifth embodiment.
Figure 16B:
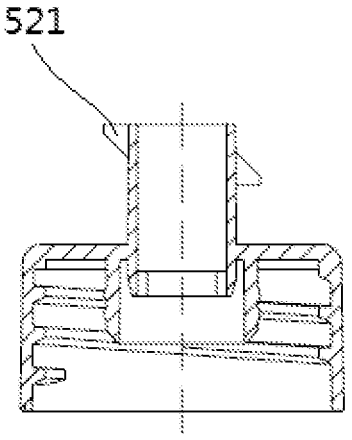
FIG. 16*b* is a cross-sectional view taken along line F-F in FIG. 16*a*.

Protruding claws 546 are respectively provided on free ends of the two cantilevers 542 shown in the figure, and correspondingly, two guide wedges 521 corresponding to the two protruding claws 546 are provided on the threaded sleeve 520, for example, on the upper sleeve of the threaded sleeve 520. As shown in FIGS. 16*a* and 16*b*, one guide wedge 521 of the two guide wedges 521 comprises an inclined face facing upwardly, and the other guide wedge 521 comprises an inclined face facing downwardly.

The operation principle of the liquid pump 500 of the above structure will be described in detail below.

When the liquid pump 500 is not in use, the relaxation push plate 540 is in the first position, and at this time, the lower step faces 544 of the relaxation push plate 540 are in contact with the upper base 532 of the elastic mechanism 530, such that the elastic strip 531 of the elastic mechanism 530 is in the relaxed state.

When using the liquid pump 500, the user applies a downward pressing force to the pressing head 510. As the pressing head 510 moves downwardly, the relaxation push plate 540 also moves downwardly, and one of the cantilevers 542 thereof comes into contact with the corresponding guide wedge 521 with the upward-facing inclined face, for example, in the figure, the protruding claw 546 of the cantilever 542 comes into contact with and interacts with the guide wedge 521. Under the action of the inclined face of the guide wedge 521, the relaxation push plate 540 moves linearly from the first position towards the second position.

When the relaxation push plate 540 moves to the second position, the upper step faces 543 of the relaxation push plate 540 come into contact with the upper base 532 of the elastic mechanism 530, such that the elastic strip 531 is in the preloaded state.

After one time of pumping, the pressing force is removed from the pressing head 510, and the pressing head 510 and the relaxation push plate 540 move upwardly under the elastic action of the elastic strip 531. During the upward movement, the other cantilever 542 of the relaxation push plate 540, for example, the protruding claw 546 thereof, comes into contact with and interacts with the corresponding other guide wedge 521 with the downward-facing inclined face. Under the action of the inclined face of the other guide wedge 521, the relaxation push plate 540 is returned from the second position to the first position, such that the elastic strip 531 of the elastic mechanism 530 returns to the relaxed state.

In this way, automatic switching of the relaxation push plate 540 between the first position and the second position is achieved by the interaction between the relaxation push plate 540 and the guide wedges 521 on the threaded sleeve 520.

Sixth Embodiment

FIGS. 17*a* to 19*b* show a liquid pump 600 of a sixth embodiment of the present invention. In the following description of the sixth embodiment, for the sake of brevity, the features that are not included in the previous embodiments are mainly described, and the same technical features as those of the previous embodiments will not be described in detail.

Figure 17A:
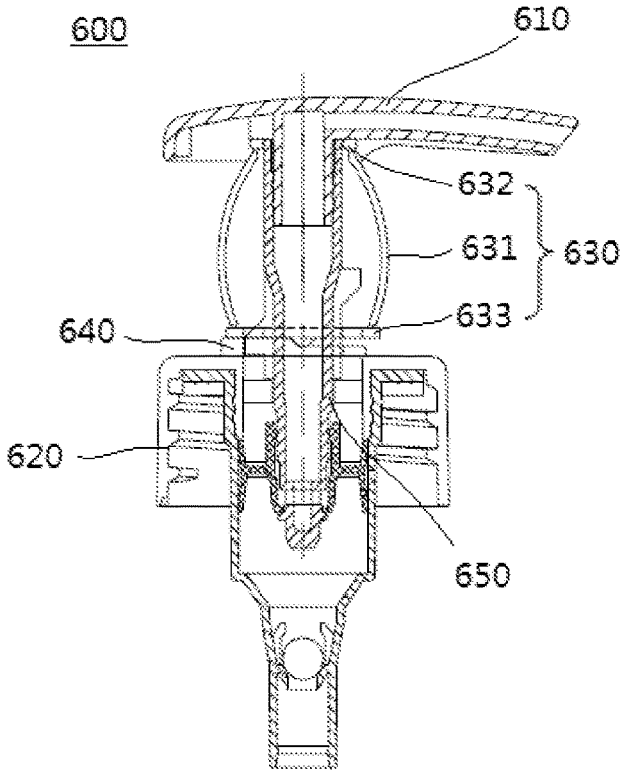
FIG. 17*a* is a cross-sectional view of a liquid pump of a sixth embodiment of the present invention, with the liquid pump being in an unpressed state.
Figure 17B:
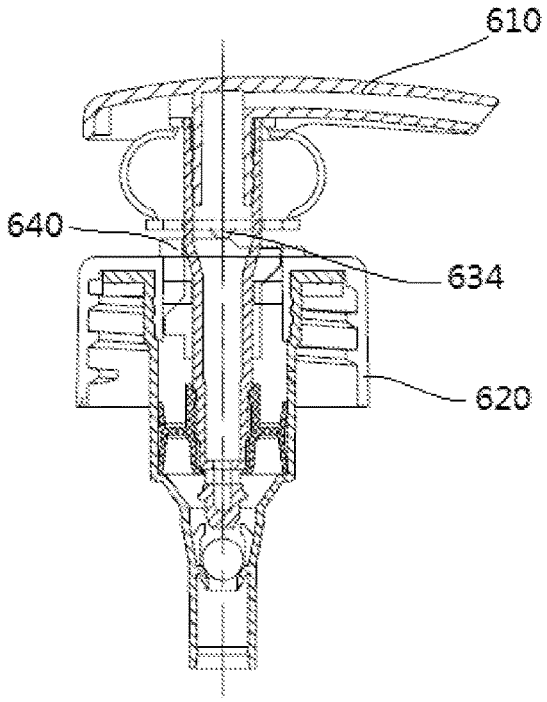
FIG. 17*b* is another cross-sectional view of the liquid pump shown in FIG. 17*a*, with the liquid pump being in a depressed state.

As shown in FIGS. 17*a* and 17*b*, the liquid pump 600 comprises a pressing head 610, a threaded sleeve 620, and an elastic mechanism 630 provided between the pressing head 610 and the threaded sleeve 620. The elastic mechanism 630 comprises an upper base 632, a lower base 633, and at least one elastic strip 631 connected between the upper base 632 and the lower base 633.

Figure 19A:
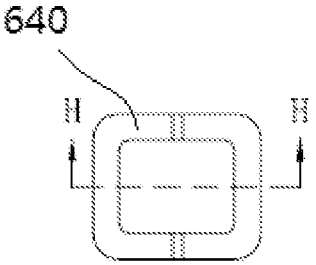
FIG. 19*a* is a top view of a push plate of the liquid pump of the sixth embodiment.
Figure 19B:
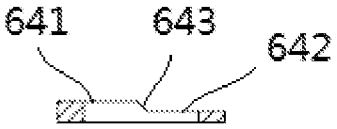
FIG. 19*b* is a cross-sectional view taken along line H-H in FIG. 19*a*.

In the sixth embodiment, a relaxation push plate 640 is provided between the lower base 633 of the elastic mechanism 630 and the threaded sleeve 620. FIGS. 19*a* and 19*b* show the structure of the relaxation push plate 640. An upper surface of the relaxation push plate 640 is in the shape of a step, and comprises an upper step face 641 and a lower step face 642. Between the upper step face 641 and the lower step face 642 is a transition face 643 in the form of an inclined face. Of course, the transition face 643 may also be an arc-shaped face.

Correspondingly, a protrusion 634 is formed on a lower surface of the lower base 633, and the protrusion 634 is in contact with the upper step face 641 or the lower step face 642 of the relaxation push plate 640. The relaxation push plate 640 can move linearly between the first position and the second position. In the first position, the protrusion 634 is in contact with the lower step face 642 of the relaxation push plate 640, such that the distance between the upper base 632 and the lower base 633 of the elastic mechanism 630 is relatively large, and the elastic strip 631 is in the relaxed state. In the second position, the protrusion 634 is in contact with the upper step face 641 of the relaxation push plate 640, such that the distance between the upper base 632 and the lower base 633 of the elastic mechanism 630 is reduced, and the elastic strip 631 is thus preloaded.

Figure 18A:
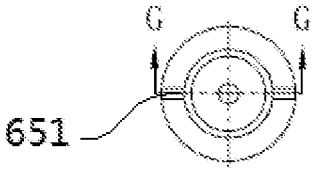
FIG. 18*a* is a bottom view of a piston rod of the liquid pump of the sixth embodiment.
Figure 18B:
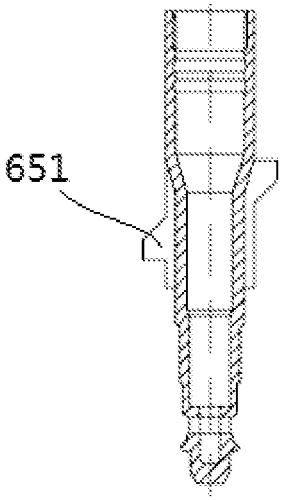
FIG. 18*b* is a cross-sectional view taken along line G-G in FIG. 18*a*.

A piston rod 650 is connected to a lower sleeve of the push plate 640. As shown in FIGS. 18*a* and 18*b*, the piston rod 650 is formed with two guide wedges 651 arranged opposite each other, wherein one guide wedge 651 comprises an inclined face facing upwardly, and the other guide wedge 651 comprises an inclined face facing downwardly.

The operation principle of the liquid pump 600 of the above structure will be described in detail below.

When the liquid pump 600 is not in use, the relaxation push plate 640 is in the first position, and the lower step face 642 of the relaxation push plate 640 is in contact with the protrusion 634 on the lower surface of the lower base 633 of the elastic mechanism 630, such that the elastic strip 631 is in the relaxed state.

In the process of using the liquid pump 600, the user applies a downward pressing force to the pressing head 610, such that the piston rod 650 connected to a lower sleeve of the pressing head 610 also moves downwardly. During the downward movement of the piston rod 650, the guide wedge 651 of the piston rod 650 that comprises the downward-facing inclined face comes into contact with and interacts with the relaxation push plate 640. Under the action of the guide wedge 651 comprising the downward-facing inclined face, the relaxation push plate 640 moves linearly from the first position towards the second position, such that the protrusion 634 of the elastic mechanism 630 comes into contact with the upper step face 641 of the push plate 640. In this way, the elastic strip 631 of the elastic mechanism 630 is changed into the preloaded state.

After one time of pumping, the user removes the pressing force from the pressing head 610, and the pressing head 610 moves upwardly under the action of the elastic force from the elastic mechanism 630. During the upward movement, the other guide wedge 651 of the piston rod 650 that comprises the upward-facing inclined face comes into contact with and interacts with the relaxation push plate 640. Under the action of the guide wedge 651 comprising the upward-facing inclined face, the relaxation push plate 640 returns from the second position to the first position, such that the protrusion 634 of the elastic mechanism 630 comes into contact with the lower step face 642 of the relaxation push plate 640. In this way, the elastic strip 631 of the elastic mechanism 630 returns to the relaxed state.

Therefore, in the sixth embodiment, automatic switching of the relaxation push plate 640 between the first position and the second position is achieved by the interaction between the relaxation push plate 640 and the guide wedges 651 of the piston rod 650.

Seventh Embodiment

FIGS. 20*a* to 22*d* show a liquid pump 700 of a seventh embodiment of the present invention. In the following description of the seventh embodiment, for the sake of brevity, the features that are not included in the previous embodiments are mainly described, and the same technical features as those of the previous embodiments will not be described in detail.

Figure 20A:
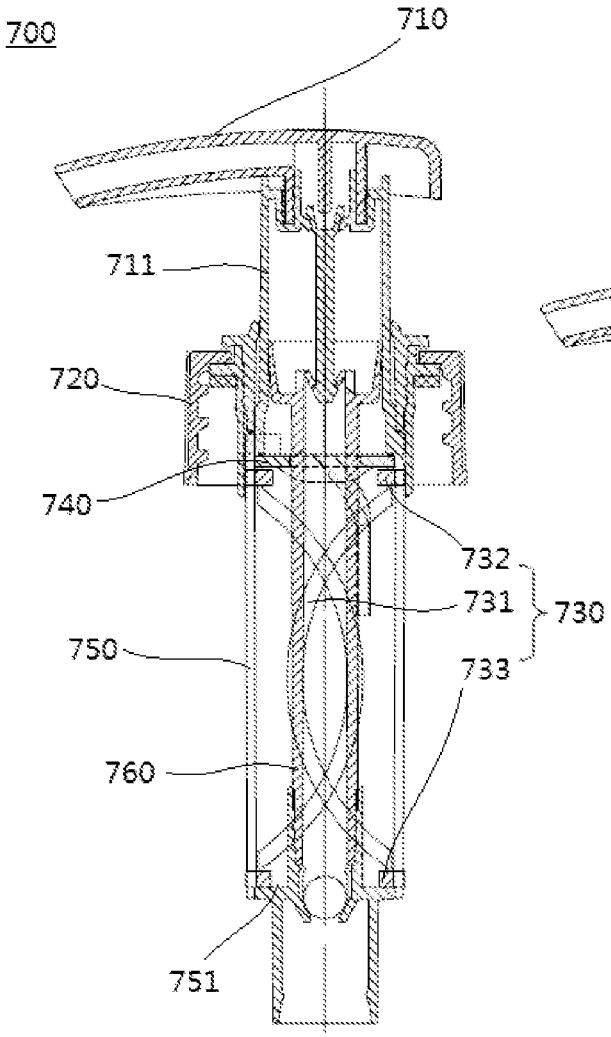
FIG. 20*a* is a cross-sectional view of a liquid pump of a seventh embodiment of the present invention, with the liquid pump being in an unpressed state.
Figure 20B:
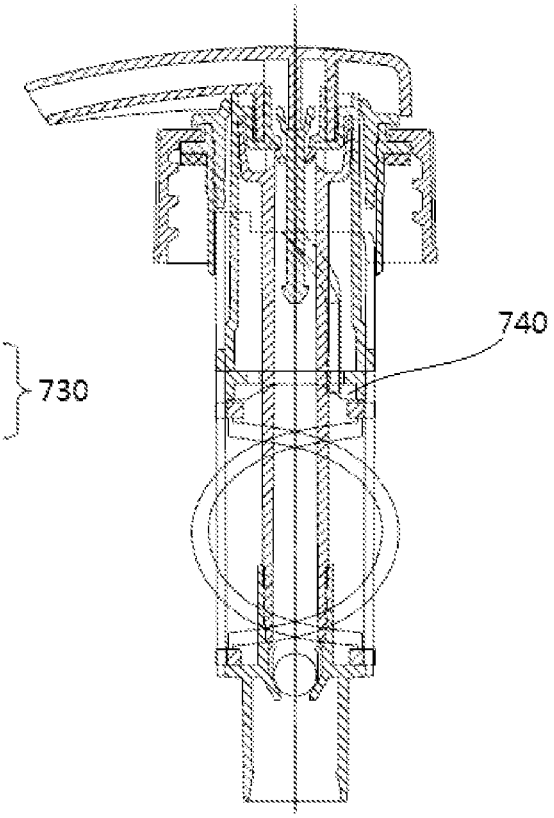
FIG. 20*b* is another cross-sectional view of the liquid pump shown in FIG. 20*a*, with the liquid pump being in a depressed state.

As shown in FIGS. 20*a* and 20*b*, the liquid pump 700 comprises a pressing head 710, a threaded sleeve 720 and a cylinder 750. A piston rod 760 is fixed inside the cylinder 750. The pressing head 710 comprises a lower sleeve 711, an upper base 732 of an elastic mechanism 730 abuts against a lower end of the lower sleeve 711, and a lower base 733 of the elastic mechanism 730 abuts against a shoulder 751 inside the cylinder 750. Therefore, the elastic mechanism 730 applies an upward biasing force to the pressing head 710.

In the seventh embodiment of the present invention, a relaxation ring 740 is further provided between the lower end of the sleeve 711 of the pressing head 710 and the upper base 732 of the elastic mechanism 730. The relaxation ring 740 is ring-shaped, and the structure thereof is shown in FIGS. 22*a* to 22*d*. A lower surface of the relaxation ring 740 is formed with a raised supporting face 742 and a recessed supporting face 743. Moreover, the relaxation ring 740 can rotate between the first position and the second position. In the first position, the recessed supporting face 743 is in contact with the upper base 732 of the elastic mechanism 730, such that the distance between the upper base 732 and the lower base 733 is relatively large, and the elastic strip 731 of the elastic mechanism 730 is in the relaxed state. In the second position, the raised supporting face 742 is in contact with the upper base 732 of the elastic mechanism 730, such that the distance between the upper base 732 and the lower base 733 becomes smaller, and the elastic strip 731 of the elastic mechanism 730 is thus preloaded.

Figure 21A:
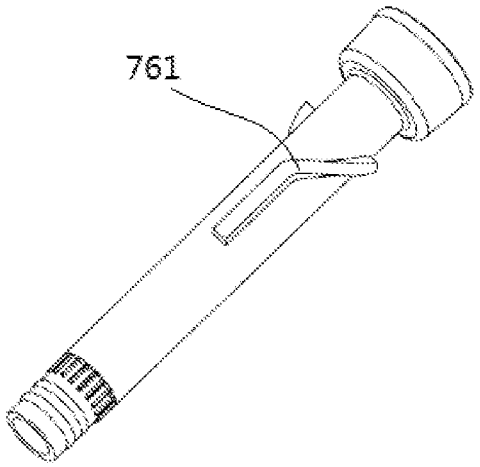
FIG. 21*a* is a perspective view of a piston rod of the liquid pump of the seventh embodiment.
Figure 21B:
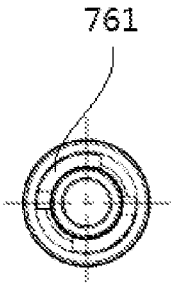
FIG. 21*b* is a front view of the piston rod shown in FIG. 21*a*.
Figure 21C:
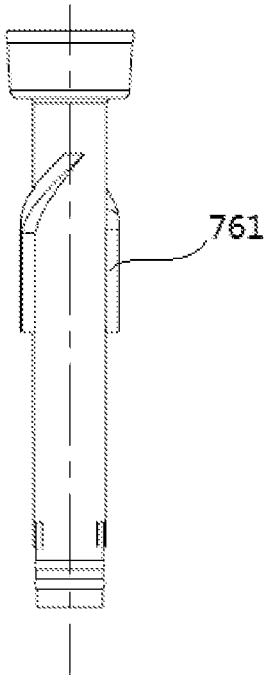
FIG. 21*c* is a bottom view of the piston rod shown in FIG. 21*a*.

The rotation of the relaxation ring 740 between the first position and the second position can be achieved automatically. By way of example, as shown in FIGS. 22*a* to 22*d*, at least one, and preferably two opposed grooves 741 are formed in an inner surface of the relaxation ring 740. Corresponding to the groove 741, at least one, and preferably two opposed guide ribs 761 are formed on the piston rod 760, as shown in FIGS. 21*a* to 21*c*. The guide rib 761 comprises an upper inclined portion and a lower vertical portion. In the installed state, the groove 741 of the relaxation ring 740 is mated with the guide rib 761 of the piston rod 760.

When the relaxation ring 740 moves downwardly, the groove 741 first is mated with the inclined portion of the guide rib 761, and rotates from the first position towards the second position under the action of the inclined portion, and when the groove 741 enters and is mated with the vertical portion of the guide rib 761, the relaxation ring 740 reaches the second position and stops rotating.

Figure 22A:
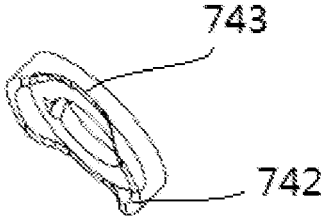
FIG. 22*a* is a bottom perspective view of a relaxation ring in the liquid pump of the seventh embodiment.
Figure 22B:
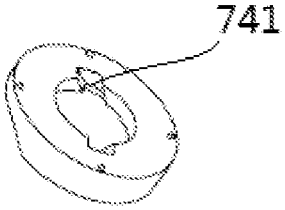
FIG. 22*b* is a top perspective view of the relaxation ring shown in FIG. 22*a*.
Figure 22C:
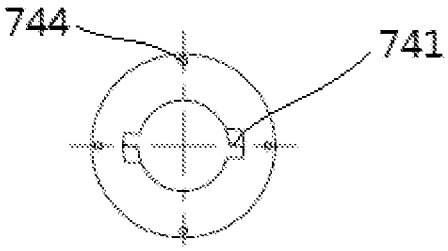
FIG. 22*c* is a top view of the relaxation ring shown in FIG. 22*a*.
Figure 22D:
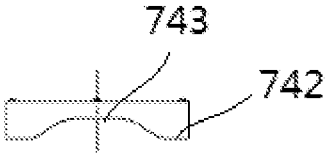
FIG. 22*d* is a side view of the relaxation ring shown in FIG. 22*a*.

Preferably, as shown in FIG. 22*c*, a number of bead points 744 (four shown in the figure) are formed on a surface of the relaxation ring 740 that is opposite the lower end of the lower sleeve 711 of the pressing head 710, and the bead points 744 are in contact with the lower end of the lower sleeve 711 so as to reduce the frictional resistance to the relaxation ring 740 as it rotates.

It is to be explained here that the above structural arrangements of the groove and the rib are interchanged, that is, a guide groove is formed on the piston rod 760, and the inner surface of the relaxation plate 740 is formed with a protrusion matching the shape of the guide groove, and this structure is also within the scope of the present invention.

The operation principle of the liquid pump 700 of the above structure will be described in detail below.

When the liquid pump 700 is not in use, the pressing head 710 is at an upper dead point of the stroke, and the relaxation ring 740 is in the first position. At this time, the recessed supporting face 743 of the relaxation ring 740 is in contact with the upper base 732 of the elastic mechanism 730, and the elastic strip 731 of the elastic mechanism 730 is in the relaxed state.

When using the liquid pump 700, the user applies a downward pressing force to the pressing head 710 to move the pressing head 710 downwardly, and the relaxation ring 740 abutting against the lower end of the lower sleeve 711 of the pressing head 710 also moves downwardly. During the downward movement of the relaxation ring 740, the groove 741 in the relaxation ring 740 first is mated with the upper inclined portion of the guide rib 761 in the piston rod 760, and rotates from the first position towards the second position under the action of the inclined portion of the guide rib 761.

As the pressing head 710 continues to be pressed downwardly, the relaxation ring 740 moves to a position where the groove 741 thereof is mated with the vertical portion of the guide rib 761, and the relaxation ring 740 rotates to the second position at this time. In this case, the raised supporting face 742 of the relaxation ring 740 is in contact with the upper base 732 of the elastic mechanism 730, and the elastic strip 731 of the elastic mechanism 730 enters the preloaded state. Thereafter, continuing to press the pressing head 710 down will not cause further rotation of the relaxation ring 740.

After one time of pumping, the user removes the pressing force applied to the pressing head 710, the pressing head 710 returns upwardly to the upper dead point thereof under the action of the elastic force from the elastic mechanism 730, and the relaxation ring 740 also moves upwardly therewith. When the relaxation ring 740 moves to a position where the groove 741 thereof is mated with the inclined portion of the guide rib 761, the relaxation ring 740 starts to rotate from the second position to the first position under the action of the inclined portion. When the pressing head 710 reaches the upper dead point of the stroke thereof, the relaxation ring 740 also reaches the first position thereof, such that the recessed supporting face 743 of the relaxation ring 740 is in contact with the upper base 732 of the elastic mechanism 730, and the elastic strip 731 of the elastic mechanism 730 returns to the relaxed state thereof.

Eighth Embodiment

Figure 23:
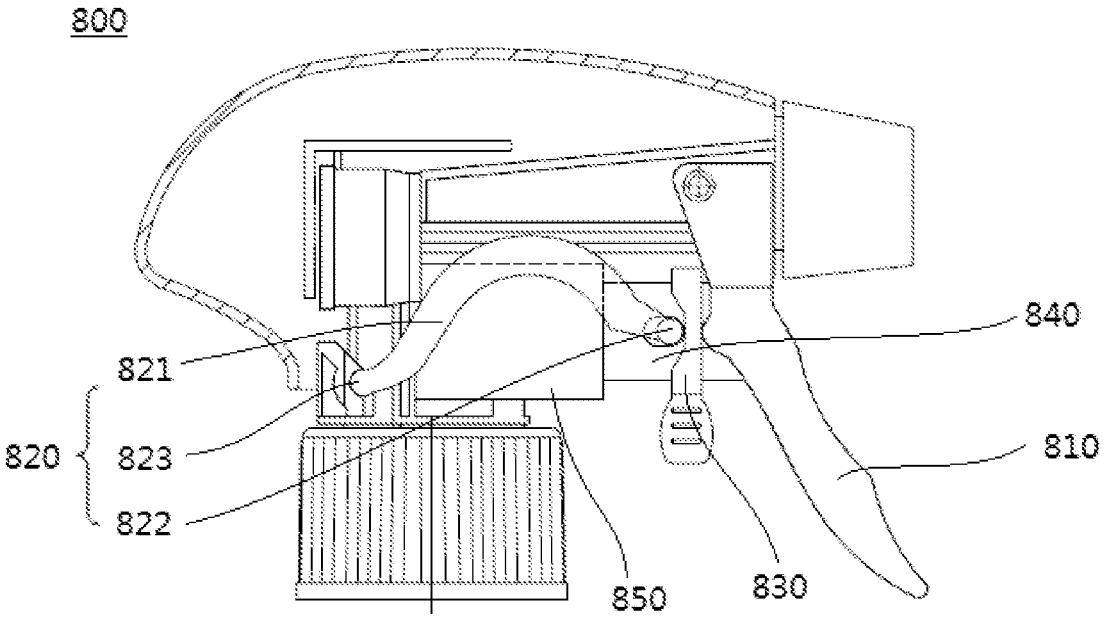
FIG. 23 is a side view of a liquid pump of an eighth embodiment of the present invention.
Figure 24:
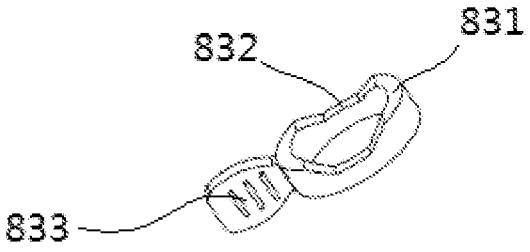
FIG. 24 is a perspective view of a relaxation plate of the liquid pump of the eighth embodiment.
Figure 25:
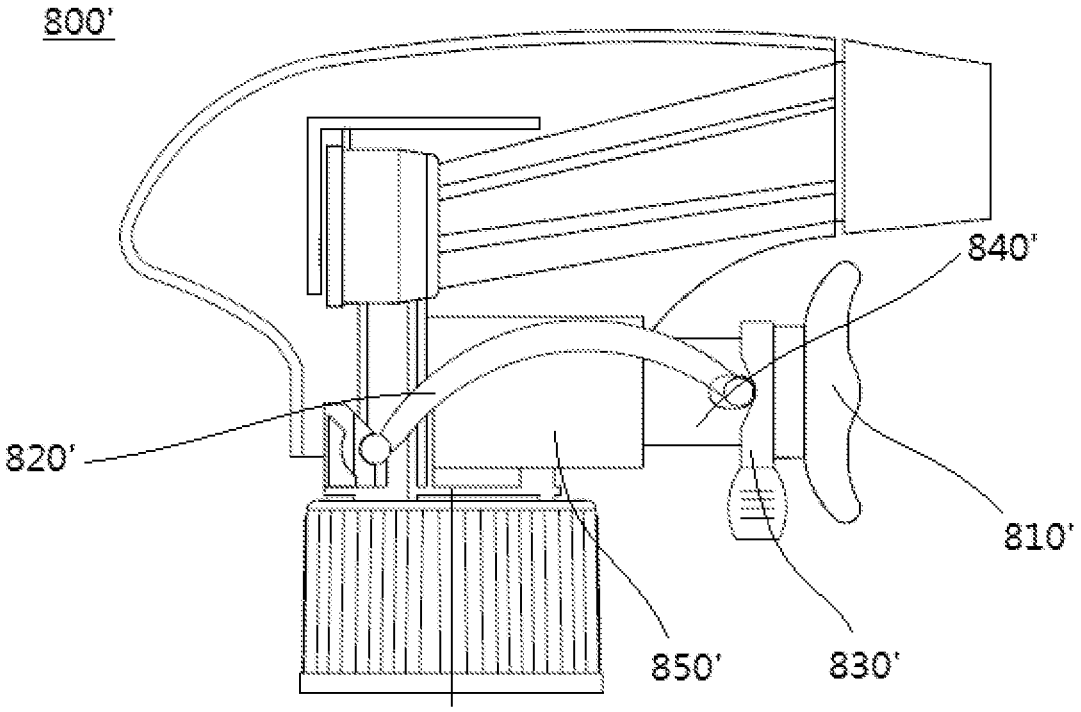
FIG. 25 shows a variant structure of the liquid pump of the eighth embodiment.

FIGS. 23 to 25 show a liquid pump 800 of an eighth embodiment of the present invention, and a liquid pump 800' of a variant structure. In the following description of the eighth embodiment, for the sake of brevity, the features that are not included in the previous embodiments are mainly described, and the same technical features as those of the previous embodiments will not be described in detail.

First, unlike the previous embodiments, the liquid pumps 800, 800' shown in FIGS. 23 to 25 are spray gun-type liquid pumps. As shown in FIG. 23, the liquid pump 800 has a cylinder 850 and a piston rod 840. The piston rod 840 can move inside the cylinder 850. A pivoting trigger 810 is provided on the piston rod 840 for actuating the piston rod 840. When the user applies a pressing force to the pivoting trigger 810, the pivoting trigger 810 is pivoted, and in turn the piston rod 840 is moved relative to the cylinder 850, thereby pumping the product out.

The liquid pump 800 further comprises an elastic mechanism 820. As shown in FIG. 23, the elastic mechanism 820 comprises an elastic strip 821. A first end 822 of the elastic strip 821 is fixed to the piston rod 840, and a second end 823 thereof is fixed to the cylinder 850 or another fixed component of the liquid pump 800, thereby applying, to the piston rod 840, a biasing force for restoring the piston rod relative to the cylinder 850.

In the eighth embodiment of the present invention, a relaxation plate 830 is further comprised. The relaxation plate 830 is rotatably sleeved on the piston rod 840 and abuts against the first end 822 of the elastic mechanism 820.

FIG. 24 shows the structure of the relaxation plate 830, wherein the relaxation plate 830 comprises a body, a raised face 831 and a recessed face 832 are formed on a surface of the body that faces the elastic mechanism 820, and a shifter 833 is also formed on the body of the relaxation plate 830. The relaxation plate 830 can be rotated between the first position and the second position by operating the shifter 833. In the first position, when the recessed face 832 of the relaxation plate 830 is in contact with the first end 822 of the elastic mechanism 820, and the distance between the two ends of the elastic strip 821 is relatively large, such that the elastic strip 821 is in the relaxed state. In the second position, the raised face 831 of the relaxation plate 830 is in contact with the first end 822 of the elastic mechanism 820, such that the distance between the two ends of the elastic strip 821 is reduced, and the elastic strip 821 is thus preloaded.

The operation principle of the liquid pump 800 of the above structure will be described in detail below.

When the liquid pump 800 is not in use, the relaxation plate 830 is in the first position, and the recessed face 832 thereof is in contact with the first end 822 of the elastic strip 821 of the elastic mechanism 820, such that the elastic strip 821 is in the relaxed state.

When the liquid pump 800 needs to be used, the shifter 833 of the relaxation plate 830 is operated to rotate the relaxation plate 830 from the first position to the second position. In this case, the raised face 831 of the relaxation plate 830 is in contact with the first end 822 of the elastic strip 821, such that the elastic strip 821 is preloaded.

After the use is completed, the shifter 833 is operated to rotate the relaxation plate 830 back to the first position, such that the elastic strip 821 of the elastic mechanism 820 returns to the relaxed state.

The liquid pump 800' of the variant structure of the eighth embodiment shown in FIG. 25 is basically similar in structure to the liquid pump 800 shown in FIG. 23. That is, the liquid pump 800' comprises a piston rod 840', a cylinder 850', an elastic mechanism 820' for applying a biasing force to the piston rod 840', and a relaxation plate 830' for adjusting the elastic mechanism 820'.

Unlike the liquid pump 800, an actuation mechanism of the liquid pump 800' is a pressing portion 810' coaxially mounted on the piston rod 840'. The pressing portion 810' enables the pressing force applied to the piston rod 840' to coincide with the moving direction of the piston rod 840', so that the pressing force can be used more effectively.

Ninth Embodiment

FIGS. 26*a* to 27*c* show a liquid pump 900 of a ninth embodiment of the present invention. In the following description of the ninth embodiment, for the sake of brevity, the features that are not included in the previous embodiments are mainly described, and the same technical features as those of the previous embodiments will not be described in detail.

Figure 26A:
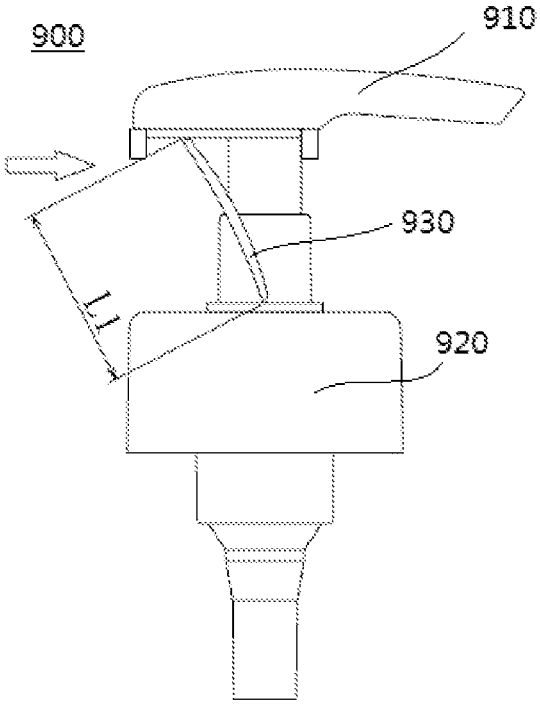
FIG. 26*a* is a side view of a liquid pump of a ninth embodiment of the present invention, with an elastic strip being in a relaxed state.
Figure 26B:
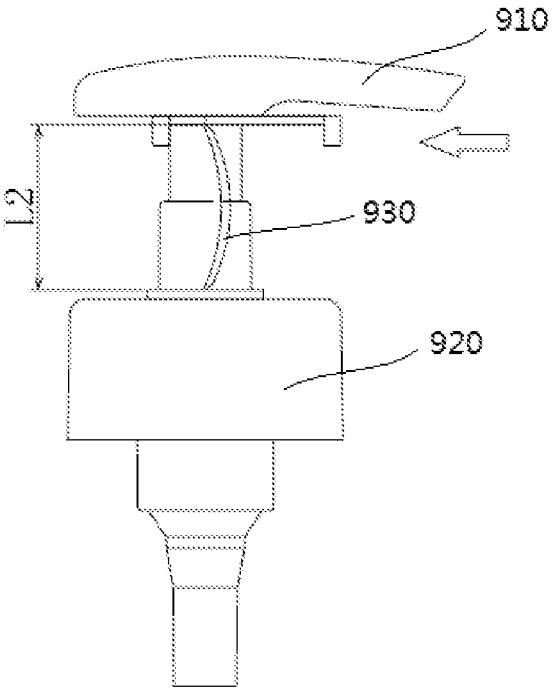
FIG. 26*b* is another side view of the liquid pump of the ninth embodiment, with the elastic strip being in a preloaded state.

As shown in FIGS. 26*a* and 26*b*, the liquid pump 900 comprises a pressing head 910 and a threaded sleeve 920, and an elastic mechanism 930 is provided between the pressing head 910 and the threaded sleeve 920 to apply an upward biasing force to the pressing head 910.

Figure 27A:
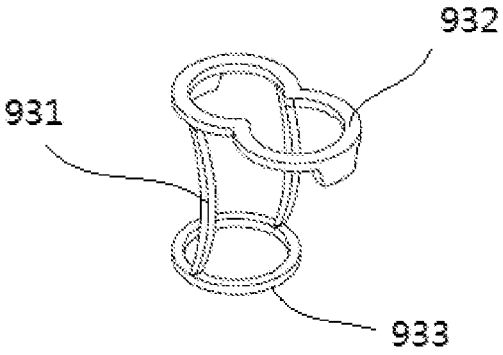
FIG. 27*a* is a perspective view of an elastic mechanism of the liquid pump of the ninth embodiment.
Figure 27B:
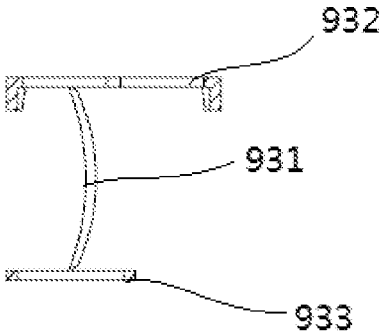
FIG. 27*b* is a cross-sectional view of the elastic mechanism shown in FIG. 27*a*.
Figure 27C:
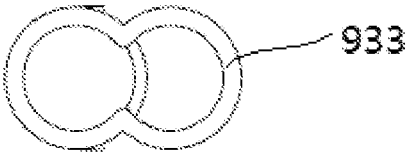
FIG. 27*c* is a top view of the elastic mechanism shown in FIG. 27*a*.
Figure 28:
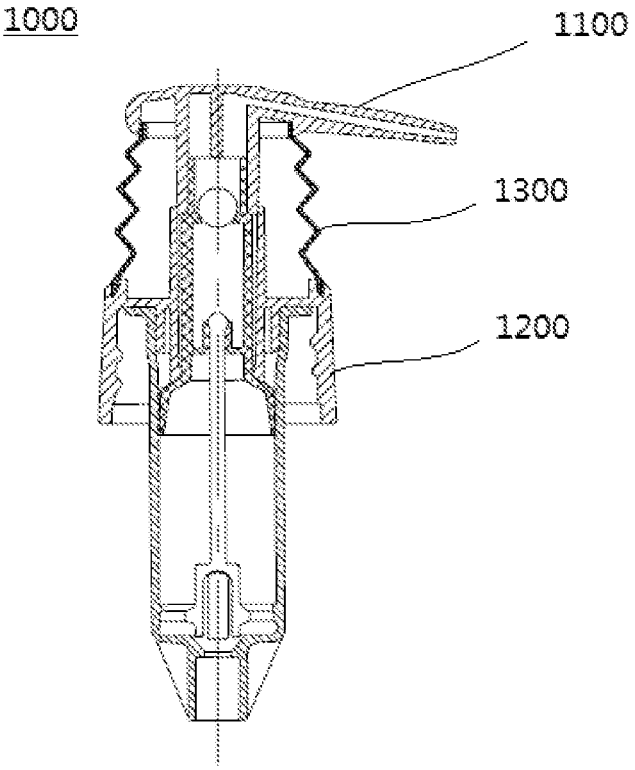
FIG. 28 shows a liquid pump of the prior art.
Figure 29:
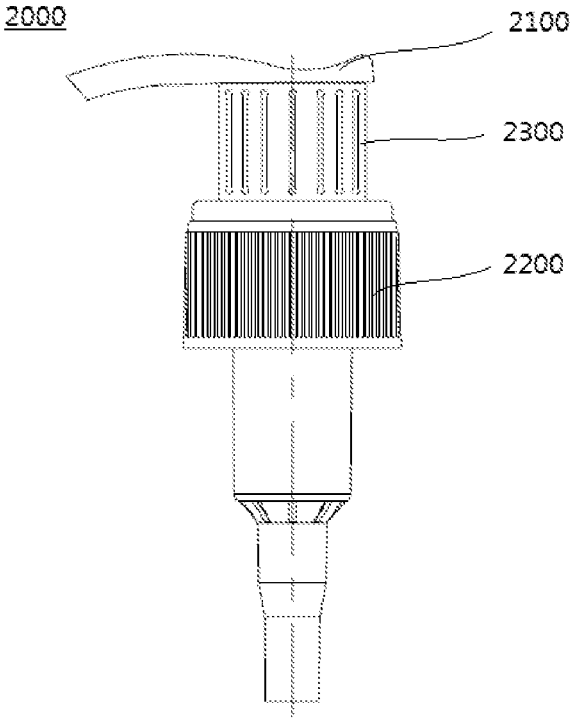
FIG. 29 shows another liquid pump of the prior art.

As shown in FIGS. 27*a* to 27*c*, the elastic mechanism 930 comprises an upper base 932, a lower base 933, and an elastic strip 931 connected between the upper base 932 and the lower base 933. One of the upper base 932 and the lower base 933 can move between the first position and the second position.

In the structure shown in FIGS. 26*a* and 26*b*, the upper base 932 can move between the first position and the second position. In the first position shown in FIG. 26*a*, the connecting line between two ends of the elastic strip 931 is inclined with respect to a longitudinal axis of the liquid pump 900, for example at an acute angle. In this way, in the first position, the distance L1 between the two ends of the elastic strip 931 is relatively large, such that the elastic strip 931 is in the relaxed state.

As shown in FIG. 26*b*, in the second position of the upper base 932, the connecting line between the two ends of the elastic strip 931 is substantially parallel to the longitudinal axis of the liquid pump 900, and the distance L2 between the two ends of the elastic strip 931 is thus smaller than the distance L1 when in the first position, such that the elastic strip 931 is preloaded.

Here, in the second position, the connecting line between the two ends of the elastic strip 931 may also not be parallel to the longitudinal axis of the liquid pump 900, as long as the included angle between the connecting line between the two ends of the elastic strip 931 and the longitudinal axis of the liquid pump 900 is less than the included angle between the connecting line between the two ends of the elastic strip 931 and the longitudinal axis of the liquid pump 900 when in the first position, which can also make L2 less than L1, such that in the second position, the elastic strip 931 is in the preloaded state.

In addition, in the ninth embodiment, it is also possible that the lower base 933 can move between the first position and the second position.

The operation principle of the liquid pump 900 of the above structure will be described in detail below.

When the liquid pump 900 is not in use, the upper base 932 of the elastic mechanism 930 is in the first position, and the distance between the two ends of the elastic strip 931 of the elastic mechanism 930 is relatively large, such that the elastic strip 931 is in the relaxed state.

When the liquid pump 900 needs to be operated, the upper base 932 of the elastic mechanism 930 is pushed to move same from the first position towards the second position. When the upper base 932 moves to the second position, the distance between the two ends of the elastic strip 931 is reduced, such that the elastic strip 931 is preloaded.

After the use of the liquid pump 900 is completed, the user pushes the upper base 932 in the reverse direction to return the upper base 932 from the second position to the first position, such that the elastic strip 931 returns to the relaxed state.

<Other Variant Structures>

The specific embodiments of the present invention are described in detail above. On the basis of these embodiments, modifications and variations obvious to those skilled in the art may also be made, which are also within the scope of protection of the present invention.

In the above embodiments, the elastic mechanism comprises an upper base and a lower base. However, according to actual situations, it is also possible that at least one of the upper base and the lower base is not comprised. Instead, the corresponding end of the elastic strip is directly connected to the pressing head or the threaded sleeve.

In the structure of each embodiment shown in the figures, the elastic mechanism generally comprises two elastic strips. However, another number of the elastic strips may be provided according to requirements, such as one, three, or more, and these elastic strips may be arranged at either even intervals or uneven intervals from each other.

In the structures shown in the figures, when the pressing head is pressed down, most of the elastic strips of the elastic mechanism are deformed radially outwardly. However, those skilled in the art can appreciate that the elastic strip is also configured to deform radially inwardly as the pressing head is pressed down where the space permits.

The invention claimed is:

1. A liquid pump, comprising:

a movable unit and a fixed unit, the movable unit being capable of moving relative to the fixed unit so as to pump a product out; and an elastic mechanism being provided between the movable unit and the fixed unit, and the elastic mechanism comprising at least one elastic strip which applies a biasing force to the movable unit to restore the movable unit after the product is pumped, where the liquid pump further comprises an elastic mechanism adjusting member formed on or connected to the elastic mechanism, and the elastic mechanism adjusting member is movable between a first position in which the elastic strip of the elastic mechanism is in a relaxed state, and a second position in which the elastic strip of the elastic mechanism is in a preloaded state;

wherein the liquid pump is a press-type liquid pump, wherein the movable unit comprises a pressing head and a piston rod connected to the pressing head, the fixed unit comprises a threaded sleeve and a cylinder connected to the threaded sleeve;

wherein the elastic mechanism comprises an upper base and a lower base, the upper base rotatably abuts against the pressing head, and the lower base rotatably abuts against the threaded sleeve;

wherein the elastic mechanism adjusting member comprises the lower base, wherein a lower surface of the lower base is formed with a raised supporting face and a recessed supporting face, a bump is formed on the threaded sleeve, the recessed supporting face is mated with the bump when the elastic mechanism adjusting member is in the first position, and the raised supporting face is mated with the bump when the elastic mechanism adjusting member is in the second position, a shifter is formed on the lower base, and the elastic mechanism adjusting member is rotated between the first position and the second position by operating the shifter; or the elastic mechanism adjusting member comprises the upper base, wherein an upper surface of the upper base is formed with a raised supporting face and a recessed supporting face, a bump is formed at a lower portion of the pressing head, the recessed supporting face is mated with the bump when the elastic mechanism adjusting member is in the first position, and the raised supporting face is mated with the bump when the elastic mechanism adjusting member is in the second position, a shifter is formed on the upper base, and the elastic mechanism adjusting member is rotated between the first position and the second position by operating the shifter.

2. The liquid pump of claim 1, wherein the elastic mechanism is made of a non-metallic material with elasticity.

3. A liquid pump, comprising:

a movable unit and a fixed unit, the movable unit being capable of moving relative to the fixed unit so as to pump a product out; and an elastic mechanism being provided between the movable unit and the fixed unit, and the elastic mechanism comprising at least one elastic strip which applies a biasing force to the movable unit to restore the movable unit after the product is pumped, where the liquid pump further comprises an elastic mechanism adjusting member formed on or connected to the elastic mechanism, and, the elastic mechanism adjusting member is movable between a first position in which the elastic strip of the elastic mechanism is in a relaxed state, and a second position in which the elastic strip of the elastic mechanism is in a preloaded state;

wherein the liquid pump is a press-type liquid pump, wherein the movable unit comprises a pressing head and a piston rod connected to the pressing head, the fixed unit comprises a threaded sleeve and a cylinder connected to the threaded sleeve;

wherein the elastic mechanism comprises an upper base and a lower base, wherein one of a lower surface of the lower base and an upper surface of the upper base is formed with a raised supporting face and a recessed supporting face;

the elastic mechanism adjusting member comprises one base of the lower base and the upper base and comprises a relaxation ring, the relaxation ring is located between the one base and the threaded sleeve, a bump is formed on the relaxation ring, the bump is mated with the recessed supporting face when the elastic mechanism adjusting member is in the first position, and the bump is in contact with the raised supporting face when the elastic mechanism adjusting member is in the second position; and the relaxation ring is further formed with at least one shifter, and the elastic mechanism adjusting member is rotated between the first position and the second position by operating the shifter.

4. A liquid pump, comprising:

a movable unit and a fixed unit, the movable unit being capable of moving relative to the fixed unit so as to pump a product out; and an elastic mechanism being provided between the movable unit and the fixed unit, and the elastic mechanism comprising at least one elastic strip which applies a biasing force to the movable unit to restore the movable unit after the product is pumped, where the liquid pump further comprises an elastic mechanism adjusting member formed on or connected to the elastic mechanism, and, the elastic mechanism adjusting member is movable between a first position in which the elastic strip of the elastic mechanism is in a relaxed state, and a second position in which the elastic strip of the elastic mechanism is in a preloaded state;

wherein the liquid pump is a press-type liquid pump, wherein the movable unit comprises a pressing head and a piston rod connected to the pressing head, the fixed unit comprises a threaded sleeve and a cylinder connected to the threaded sleeve;

wherein the elastic mechanism comprises a lower base, and the elastic mechanism adjusting member comprises a push plate provided between the lower base and the threaded sleeve, wherein the push plate comprises: two end plates located at two ends, and side plates extending between the end plates, and an upper surface of each of the side plates is formed in the shape of a step and comprises an upper step face and a lower step face; and the push plate is linearly movable between the first position in which the lower step faces are in contact with a supporting face of the lower base, and the second position in which the upper step faces are in contact with the supporting face of the lower base.

5. A liquid pump, comprising:

a movable unit and a fixed unit, the movable unit being capable of moving relative to the fixed unit so as to pump a product out; and an elastic mechanism being provided between the movable unit and the fixed unit, and the elastic mechanism comprising at least one elastic strip which applies a biasing force to the movable unit to restore the movable unit after the product is pumped, where the liquid pump further comprises an elastic mechanism adjusting member formed on or connected to the elastic mechanism, and, the elastic mechanism adjusting member is movable between a first position in which the elastic strip of the elastic mechanism is in a relaxed state, and a second position in which the elastic strip of the elastic mechanism is in a preloaded state;

wherein the liquid pump is a press-type liquid pump, wherein the movable unit comprises a pressing head and a piston rod connected to the pressing head, the fixed unit comprises a threaded sleeve and a cylinder connected to the threaded sleeve;

wherein the elastic mechanism adjusting member automatically moves between the first position and the second position by means of one of the following structures:

1) the elastic mechanism adjusting member comprises a sleeve formed on the elastic mechanism, and at least one bump is formed on an inner surface of the sleeve;

a guide groove is formed on an upper sleeve of the threaded sleeve, the bump is accommodated in the guide groove, and the guide groove comprises an upper inclined portion and a lower vertical portion; and the elastic mechanism comprises an upper base, wherein an upper surface of the upper base is formed with a raised platform and a recessed platform; and a pressing head bump is formed at a lower portion of the pressing head, wherein when the pressing head is at an upper dead point of a stroke of the pressing head, the sleeve is in the first position, and the recessed platform of the upper base is in contact with the pressing head bump; and the pressing head is pressed down so that the bump and the inclined portion of the guide groove interact with each other, such that the sleeve is rotated from the first position towards the second position, and when the bump enters into the vertical portion, the sleeve rotates to the second position, such that the raised platform of the upper base comes into contact with the pressing head bump;

2) the elastic mechanism adjusting member comprises a push plate provided between the elastic mechanism and the pressing head, wherein the push plate comprises a plate body and first and second cantilevers suspended downwardly from the plate body, and a lower surface of the plate body is formed in the shape of a step and comprises an upper step face and a lower step face; and an upper sleeve of the threaded sleeve is provided with: a first guide wedge, which corresponds to the first cantilever and has an inclined face facing upwardly; and a second guide wedge, which corresponds to the second cantilever and has an inclined face facing downwardly, wherein when the pressing head is at an upper dead point of a stroke thereof, the push plate is in the first position in which the lower step face of the push plate is in contact with an upper base of the elastic mechanism such that the elastic strip is in the relaxed state; as the pressing head moves downwardly, the first cantilever comes into contact with and interacts with the first guide wedge to move the push plate from the first position to the second position in which the upper step face of the push plate is in contact with the upper base of the elastic mechanism such that the elastic strip is in the preloaded state; and as the pressing head moves upwardly, the second cantilever comes into contact with and interacts with the second guide wedge to return the push plate from the second position to the first position; and 3) the elastic mechanism adjusting member comprises a push plate provided between a lower base of the elastic mechanism and the threaded sleeve, wherein an upper surface of the push plate comprises an upper step face and a lower step face; and the piston rod comprises:

a first guide wedge comprising an inclined face facing downwardly; and a second guide wedge comprising an inclined face facing upwardly, wherein when the pressing head is at an upper dead point of a stroke thereof, the push plate is in the first position in which the lower step face of the push plate is in contact with the lower base such that the elastic strip in the relaxed state; as the pressing head moves downwardly, the first guide wedge comes into contact with and interacts with the push plate to move the push plate from the first position to the second position in which the upper step face of the push plate is in contact with the lower base such that the elastic strip is preloaded; and as the pressing head moves upwardly, the second guide wedge comes into contact with and interacts with the push plate to return the push plate from the second position to the first position.

6. The liquid pump of claim 5, wherein a transition face is between the upper step face and the lower step face, and the transition face is an inclined face or an arc-shaped face.

7. The liquid pump of claim 5, wherein a protruding claw is formed on a free end of at least one from the group consisting of the first cantilever and the second cantilever, and the protruding claw interacts with at least one from the group consisting of the first guide wedge and the second guide wedge.

8. The liquid pump of claim 5, wherein a protrusion is formed on a lower surface of the lower base, and the protrusion is in contact with the upper step face or the lower step face of the push plate.

9. A liquid pump, comprising:

a movable unit and a fixed unit, the movable unit being capable of moving relative to the fixed unit so as to pump a product out; and an elastic mechanism being provided between the movable unit and the fixed unit, and the elastic mechanism comprising at least one elastic strip which applies a biasing force to the movable unit to restore the movable unit after the product is pumped, where the liquid pump further comprises an elastic mechanism adjusting member formed on or connected to the elastic mechanism, and, the elastic mechanism adjusting member is movable between a first position in which the elastic strip of the elastic mechanism is in a relaxed state, and a second position in which the elastic strip of the elastic mechanism is in a preloaded state;

wherein the liquid pump is a press-type liquid pump, wherein the movable unit comprises a pressing head, the pressing head comprising a lower sleeve;

the fixed unit comprises:

a threaded sleeve;

a cylinder connected to the threaded sleeve;

a shoulder being formed in the cylinder; and a piston rod fixed inside the cylinder, and the elastic mechanism comprises an upper base and a lower base, the lower base abuts against the shoulder, and a relaxation ring is provided between the upper base and a lower end of the lower sleeve of the pressing head; a lower surface of the relaxation ring is formed with a raised supporting face and a recessed supporting face, wherein when the relaxation ring is in the first position, the recessed supporting face is in contact with the upper base, and the elastic strip is in the relaxed state; and when the relaxation ring is in the second position, the raised supporting face is in contact with the upper base, and the elastic strip is in the preloaded state;

wherein at least one groove is formed on an inner surface of the relaxation ring, at least one guide rib is formed on the piston rod, the guide rib comprises an upper inclined portion and a lower vertical portion, the groove is mated with the guide rib, and when the groove is mated with the inclined portion, the downward movement of the pressing head causes the relaxation ring to rotate from the first position to the second position, and the upward movement of the pressing head causes the relaxation ring to rotate from the second position back to the first position; or wherein at least one bump is formed on an inner surface of the relaxation ring, at least one guide groove is formed on the piston rod, the guide groove comprises an upper inclined portion and a lower vertical portion, the bump is mated in the guide groove, and when the bump is mated with the inclined portion, the downward movement of the pressing head causes the relaxation ring to rotate from the first position to the second position, and the upward movement of the pressing head causes the relaxation ring to rotate from the second position back to the first position.

* * * * *